US008586276B2

(12) United States Patent
Matsumoto et al.

(10) Patent No.: US 8,586,276 B2
(45) Date of Patent: Nov. 19, 2013

(54) CARRIER FOR ELECTROSTATIC LATENT IMAGE DEVELOPMENT, AND DEVELOPER FOR ELECTROSTATIC LATENT IMAGE DEVELOPMENT, METHOD OF FORMING AN IMAGE, DEVELOPER CARTRIDGE FOR ELECTROSTATIC LATENT IMAGE DEVELOPMENT, PROCESS CARTRIDGE AND IMAGE FORMING APPARATUS USING THE SAME

(75) Inventors: Akira Matsumoto, Kanagawa (JP); Taichi Yamada, Kanagawa (JP); Yosuke Tsurumi, Kanagawa (JP); Fusako Kiyono, Kanagawa (JP); Akihiro Iizuka, Kanagawa (JP); Fumiaki Mera, Kanagawa (JP); Hirotaka Matsuoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 969 days.

(21) Appl. No.: 12/056,904

(22) Filed: Mar. 27, 2008

(65) Prior Publication Data

US 2009/0061333 A1 Mar. 5, 2009

(30) Foreign Application Priority Data

Aug. 28, 2007 (JP) ..... 2007-221557

(51) Int. Cl.
*G03G 9/10* (2006.01)
*G03G 9/113* (2006.01)

(52) U.S. Cl.
USPC ..... 430/111.4; 430/111.3; 430/111.35; 430/124.1

(58) Field of Classification Search
USPC ..... 430/111.3, 111.35, 111.4, 124.1
See application file for complete search history.

(56) References Cited

U.S. PATENT DOCUMENTS

| | | | | |
|---|---|---|---|---|
| 5,998,076 | A * | 12/1999 | Mahabadi et al. | 430/111.32 |
| 6,746,810 | B2 | 6/2004 | Suzuki et al. | |
| 2005/0112489 | A1* | 5/2005 | Fujikawa et al. | 430/111.35 |
| 2005/0214671 | A1 | 9/2005 | Mizutani et al. | |
| 2006/0166123 | A1* | 7/2006 | Masuda | 430/111.4 |
| 2006/0269863 | A1* | 11/2006 | Nakamura et al. | 430/111.35 |
| 2007/0020552 | A1* | 1/2007 | Matsumoto et al. | 430/111.35 |
| 2007/0172748 | A1 | 7/2007 | Inoue et al. | |
| 2008/0056769 | A1* | 3/2008 | Iizuka et al. | 399/252 |

FOREIGN PATENT DOCUMENTS

| | | |
|---|---|---|
| JP | A-7-49591 | 2/1995 |
| JP | A-07-077826 | 3/1995 |
| JP | A-11-184239 | 7/1999 |

(Continued)

OTHER PUBLICATIONS

Office Action for U.S. Appl. No. 11/905,283; mailed Oct. 6, 2009.

(Continued)

*Primary Examiner* — Jonathan Jelsma
(74) *Attorney, Agent, or Firm* — Oliff & Berridge, PLC

(57) ABSTRACT

A carrier for developing an electrostatic latent image includes carrier particles, and the carrier particles include magnetic particles and a coating layer coating the surfaces of the magnetic particles. The BET specific surface area of the magnetic particles is 0.1300 $m^2/g$ to 0.2500 $m^2/g$, and the difference in BET specific surface areas obtained by subtracting the BET specific surface area of the magnetic particles from the BET specific surface area of the carrier particles is 0.0300 $m^2/g$ to 0.400 $m^2/g$.

15 Claims, 2 Drawing Sheets

(56) References Cited

FOREIGN PATENT DOCUMENTS

| | | |
|---|---|---|
| JP | A-2000-221733 | 8/2000 |
| JP | A-2001-051444 | 2/2001 |
| JP | A-2001-051453 | 2/2001 |
| JP | A-2003-140402 | 5/2003 |
| JP | A-2006-011290 | 1/2006 |
| JP | A-2006-259179 | 9/2006 |
| JP | A-2007-79045 | 3/2007 |

OTHER PUBLICATIONS

Japanese Office Action with English-language Translation issued in Application No. 2007-221557 mailed on Feb. 23, 2010.

* cited by examiner

CARRIER FOR ELECTROSTATIC LATENT IMAGE DEVELOPMENT, AND DEVELOPER FOR ELECTROSTATIC LATENT IMAGE DEVELOPMENT, METHOD OF FORMING AN IMAGE, DEVELOPER CARTRIDGE FOR ELECTROSTATIC LATENT IMAGE DEVELOPMENT, PROCESS CARTRIDGE AND IMAGE FORMING APPARATUS USING THE SAME

CROSS-REFERENCE TO RELATED APPLICATION

This application claims priority under 35 USC 119 from Japanese Patent Application No. 2007-221557 filed on Aug. 28, 2007.

BACKGROUND

1. Technical Field

The present invention relates to a carrier for developing electrostatic latent images, and a developer for electrostatic latent image development using the carrier for developing electrostatic latent images, a method of forming an image, a developer cartridge for electrostatic latent image development, a process cartridge, and an image forming apparatus.

2. Related Art

Methods for making image information visible through electrostatic latent images, such as electrophotography, are presently used in various fields. In the electrophotography method, an electrostatic latent image is formed on a photoreceptor by a charging process and an exposure process, and this electrostatic latent image is developed with a developer including a toner, and then made visible via an image transfer process and a fixing process. Developers used for the development include a two-component developer including a toner and a carrier, and a single component developer including only a toner such as a magnetic toner. The two-component developer is currently used in a wide range of applications. The carrier performs some of the functions of the developer such as stirring, conveyance and electrical charging so that the functions of the developer are separately performed by the two components; as a result, the developer has features such as good controllability. In particular, a developer using resin-coated carrier particles has excellent charge controllability, and thus it is relatively easy to make improvements thereto in terms of the dependency thereof on the environment and stability over time. As the development method, a cascade method and the like have been used in the past, but at present, a magnetic brush method using a magnetic roll as a developer-conveying body, is mainly used.

SUMMARY

According to an aspect of the invention, there is provided a carrier for developing an electrostatic latent image, comprising carrier particles including magnetic particles and a coating layer that coats the surfaces of the magnetic particles, the BET specific surface area of the magnetic particles being 0.1300 $m^2/g$ to 0.2500 $m^2/g$; and the difference in BET specific surface areas obtained by subtracting the BET specific surface area of the magnetic particles from the BET specific surface area of the carrier particles is 0.0300 $m^2/g$ to 0.400 $m^2/g$.

BRIEF DESCRIPTION OF THE DRAWINGS

Exemplary embodiments of the present invention will be described in detail based on the following figures, wherein.

DETAILED DESCRIPTION

Carrier for Developing Electrostatic Latent Images

Figure 1:
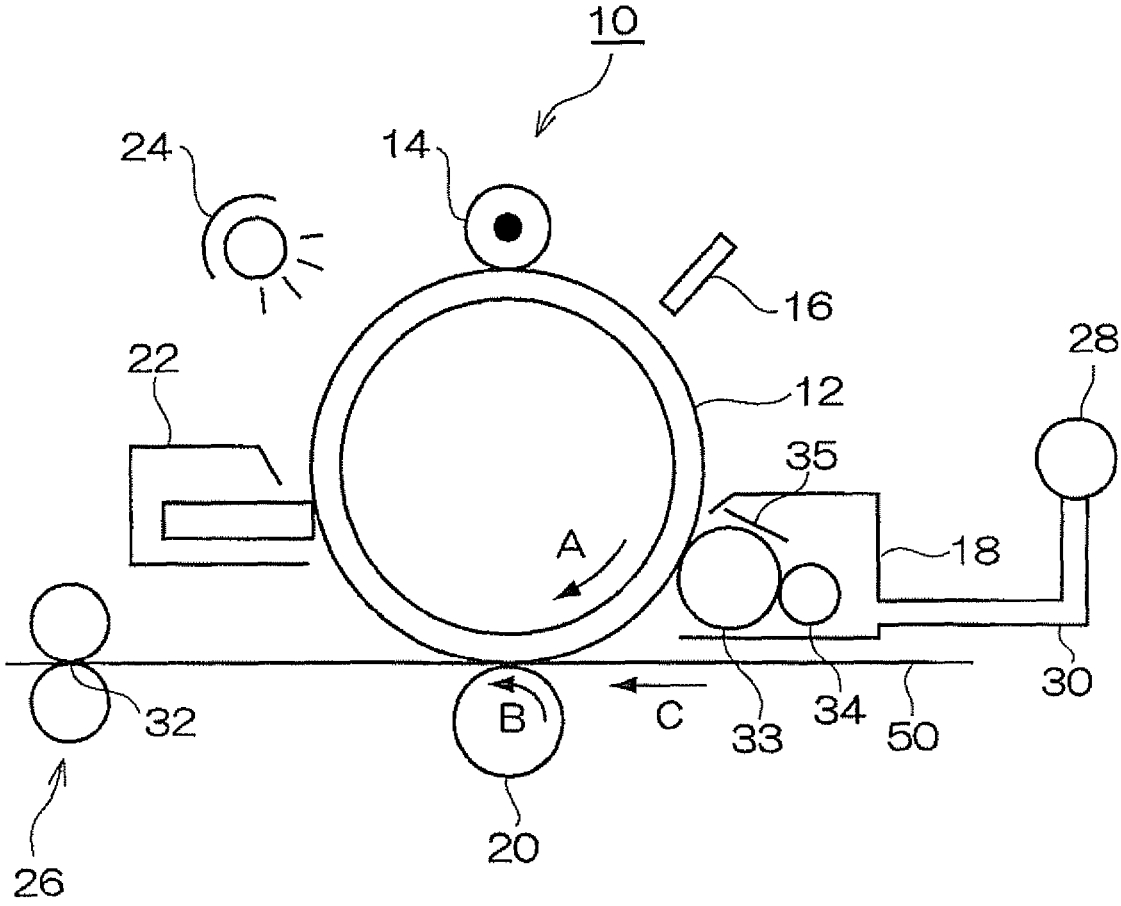
FIG. 1 is a configuration diagram schematically showing the fundamental configuration of an exemplary embodiment of the image forming apparatus of the invention.

A carrier for developing an electrostatic latent image of the invention (hereinafter, may also be referred to as "carrier of the invention") includes carrier particles including magnetic particles and a coating layer coating the surfaces of the magnetic particles, in which the BET specific surface area of the magnetic particles is 0.1300 $m^2/g$ (or about 0.1300 $m^2/g$) to 0.2500 $m^2/g$ (or about 0.2500 $m^2/g$); and the difference in BET specific surface areas (hereinafter, sometimes referred to as "difference in BET specific surface areas according to the invention") obtained by subtracting the BET specific surface area of the magnetic particles from the BET specific surface area of the carrier particles is 0.0300 $m^2/g$ (or about 0.0300 $m^2/g$) to 0.400 $m^2/g$ (or about 0.400 $m^2/g$).

Furthermore, according to the invention, the BET specific surface area of the magnetic particles, and the BET specific surface area of the magnetic particles coated with a coating layer (carrier particles) are measured by a three-point method involving nitrogen purging, using a specific surface area measuring apparatus, SA3100 (trade name, manufactured by Beckman Coulter, Inc.). Specifically, the magnetic particles or the magnetic particles coated with a coating layer are introduced as a particle sample into a 5-gram cell, and deaeration is performed at 60° C. for 120 minutes, followed by measurement using a mixed gas of nitrogen and helium (nitrogen:helium=30:70).

The BET specific surface area of the magnetic particles is typically 0.1300 $m^2/g$ to 0.2500 $m^2/g$, preferably 0.1400 $m^2/g$ to 0.2200 $m^2/g$, and more preferably 0.1500 $m^2/g$ to 0.2000 $m^2/g$.

The difference in the BET specific surface areas between the magnetic particles and the carrier particles according to the invention is typically 0.0300 $m^2/g$ (or about 0.0300 $m^2/g$) to 0.400 $m^2/g$ (or about 0.400 $m^2/g$), preferably 0.0300 $m^2/g$ (or about 0.030 $m^2/g$) to 0.1400 $m^2/g$ (or about 0.1400 $m^2/g$), more preferably 0.0500 $m^2/g$ (or about 0.0500 $m^2/g$) to 0.1300 $m^2/g$ (or about 0.1300 $m^2/g$), and further more preferably 0.0700 $m^2/g$ (or about 0.0700 $m^2/g$) to 0.1300 $m^2/g$ (or about 0.1300 $m^2/g$). When the difference in the BET specific surface areas according to the invention falls in a range of from 0.0300 $m^2/g$ to 0.1400 $m^2/g$, as a prominent effect thereof, a carrier in which less moisture adsorption occurs even under high temperature and high humidity conditions and which has a large amount of electrical charge may be obtained, regardless of the toner used in combination with the carrier.

When the difference in the BET specific surface areas according to the invention is larger than 0.1400 $m^2/g$, moisture is adsorbed into pores of the carrier particles, resulting in low charging under high temperature and high humidity conditions, and thus, if low density images are output, color spots are generated.

When the carrier of the invention includes a colorant, to be described later, and is used in combination with toner particles having a shape factor of 100 (or about 100) to 130 (or about 130), a volume average particle size of 3.0 μm (or about 3.0 μm) to 6.5 μm (or about 6.5 μm), and a particle size distribution of microparticles of 1.30 or less (or about 1.30 or less), clear images with no image density unevenness may be obtained, when the difference in the BET specific surface areas according to the invention falls in a range of from 0.0300 $m^2/g$ to 0.4000 $m^2/g$.

The carrier particles included in the carrier of the invention preferably have a volume average particle size of 20 μm (or about 20 μm) to 60 μm (or about 60 μm), more preferably 25 μm (or about 25 μm) to 55 μm (or about 55 μm), and further more preferably 30 μm (or about 30 μm) to 50 μm (or about 50 μm). When the volume average particle size of the carrier particles is larger than 60 μm, the collision energy is increased inside a developing machine, and thus breaking or cracking of the carrier particles is accelerated. Also, the surface area for imparting electrical charge to the toner may be decreased, the function of imparting electrical charge to the toner may be deteriorated, and the image definition may be lowered. Meanwhile, when the volume average particle size of the carrier particles is smaller than 20 μm, the magnetic force per unit entity is reduced, and thus, the magnetic binding power of continuous chains on the magnetic brush may be weakened to a level lower than that of an electric field for development, resulting in an increase in the migration of the carrier to the photoreceptor.

The volume average particle size of the carrier particles is measured as follows. First, 2 ml of a 5% aqueous solution of sodium alkylbenzenesulfonate is diluted with 100 ml of purified water, and 100 mg of a test sample is added to the diluted solution. The solution in which the sample is suspended is subjected to dispersion with an ultrasonic dispersing machine for 1 minute, and the particle size is measured using a laser diffraction/scattering type particle size distribution measuring apparatus (LS Particle Size Analyzer, trade name: LS13 320, manufactured by Beckman Coulter, Inc.), in water at a pump speed of 90%. The volume cumulative distribution curve is drawn from the smaller particle size side based on the counts for the respective segmented particle size ranges (channels) determined from the obtained particle size distribution, and the particle size at a cumulative value of 50% is represented by the volume average particle size, $D_{50v}$, which is considered to be the volume average particle size of the carrier particles.

With regard to the carrier of the invention, the shape factor of the magnetic particles may be 100 (or about 100) to 130 (or about 130) (or preferably 100 (or about 100) to 120 (or about 120)), and the shape factor of the magnetic particles coated with a coating layer may be 100 (or about 100) to 130 (or about 130) (or preferably 100 (or about 100) to 120 (or about 120)). When the shape factors of the magnetic particles and of the magnetic particles coated with a coating layer exceed 130, the carrier particles collide with each other, and cracks may be generated in the salient parts thereof. A shape factor that is closer to 100 means that the shape of the particle is closer to a true sphere.

Here, the shape factor of the magnetic particles or the magnetic particles coated with a coating layer is represented by the following Expression (2). According to the invention, optical microscopic images of 50 or more magnetic particles or 50 or more magnetic particles coated with a coating layer at a magnification of 250 times, are captured into an image analyzer (registered trade name: LUZEX III, manufactured by Nireco Corporation), and from the maximum lengths and the projected areas of the particles, the values of shape factor for the individual particles are calculated and averaged.

$$(ML^2/A)\times(\pi/4)\times100 \qquad \text{Expression (2)}$$

In Expression (2), ML represents the absolute maximum length of a particle, and A represents the projected area of a particle.

With regard to the carrier of the invention, the magnetic particles may satisfy the following Expression (1), and the coating layer may include a thermoplastic resin having an alicyclic group, in view of increasing the amount of electrical charge under high temperature and high humidity conditions and obtaining a clear image.

$$3.5\leq A/a\leq7.0 \qquad \text{Expression (1)}$$

In Expression (1), A represents the BET specific surface area (unit: $m^2/g$) of the magnetic particles, and "a" represents the sphere-equivalent specific surface area (unit: $m^2/g$) of the magnetic particles, which is the specific surface area per unit weight assuming that the magnetic particles are perfectly smooth spheres.

The value of A/a is more preferably 4.0 to 6.5.

The sphere-equivalent specific surface area of the magnetic particles, which is represented by "a", may be represented by an expression: $a=6/(d\times\rho)$, in which d (unit: μm) represents the volume average particle size of the magnetic particles, and ρ (unit: dimensionless) represents the true specific gravity of the magnetic particles. Thus, the sphere-equivalent specific surface area of the magnetic particles is a specific surface area per unit weight assuming that the magnetic particles are perfectly smooth spheres, and thus may be deduced as follows.

The surface area of a single magnetic particle, S ($m^2$), and the volume, V ($m^2$), are represented by the following Expressions (3) and (4).

$$S=4\pi\times\{(d/2)\times10^{-6}\}^2 \qquad \text{Expression (3)}$$

$$V=(4/3)\times\pi\times\{(d/2)\times10^{-6}\}^3 \qquad \text{Expression (4)}$$

The density of the magnetic particles is represented by $\rho\times10^6$ ($g/m^3$), and the weight M (g) of a single magnetic particle is represented by the following Expression (5).

$$M=V\times\rho\times10^6=(1/6)\pi\rho d^3\times10^{-12} \qquad \text{Expression (5)}$$

Thus, since the sphere-equivalent specific surface area, "a", is the surface area per unit weight as described above, "a" is deduced by the following Expression (6).

$$a=S/M=6/(d\times\rho) \qquad \text{Expression (6)}$$

The true specific gravity ρ of the magnetic particles is measured according to the method of measuring the density and specific gravity of a chemical product using a Le Chatelier type specific gravity bottle (known as JIS-K-0061, 5-2-1). The operation is performed as follows.

(1) About 250 ml of ethyl alcohol is introduced into a Le Chatelier specific gravity bottle, and the meniscus is adjusted to be positioned at a scale mark.

(2) The specific gravity bottle is immersed into a thermostatic water bath, and when the liquid temperature reaches 20.0±0.2° C., the position of the meniscus at a scale mark of the specific gravity bottle is accurately read (precision is 0.025 ml).

(3) About 100 g of a sample is weighed, and the weight is designated as W (g).

(4) The weighed sample is introduced into the specific gravity bottle, and bubbles are removed.

(5) The specific gravity bottle is immersed into the thermostatic water bath, and when the liquid temperature reaches 20.0±0.2° C., the position of the meniscus is accurately read at a scale mark of the specific gravity bottle (precision is 0.025 ml).

(6) The true specific gravity is calculated by the following expressions:

$$D=W/(L2-L1)$$

$$\rho=D/0.9982$$

wherein D is the density of the sample (20° C.) (g/cm$^3$); ρ is the true specific gravity of the sample (20° C.); W is the apparent weight (g) of the sample; L1 is the reading of the meniscus (20° C.) (ml) before the sample is introduced into the specific gravity bottle; L2 is the reading of the meniscus (20° C.) (ml) after the sample is introduced into the specific gravity bottle; and 0.9982 is the density (g/cm$^3$) of water at 20° C.

The coating layer for the carrier of the invention preferably includes a resin with low polarity. Examples of the resin include a thermoplastic resin having an alicyclic group. The thermoplastic resin having an alicyclic group is not particularly limited as long as it has an alicyclic group and thermoplasticity, and may be selected depending on the purpose. The thermoplastic resin having an alicyclic group may be a homopolymer of a monomer having an alicyclic group, or may be a copolymer of a monomer having an alicyclic group and one or more additional monomers, as long as the resin obtained as a result of polymerization exhibits thermoplasticity.

Specific examples of the monomer having an alicyclic group include: alicyclic group-containing acrylic monomers such as cyclopropyl acrylate, cyclobutyl acrylate, cyclopentyl acrylate, cyclohexyl acrylate, cyclopropyl methacrylate, cyclobutyl methacrylate, cyclopentyl methacrylate, cyclohexyl methacrylate, or derivatives thereof; monomers that constitute norbornene resins; monomers that constitute polycarbonate resins; monomers that constitute polyester resins each having an alicyclic group; cyclohexanedimethanol; cyclohexanedicarboxylic acid; and biphenyl Z. Among them, the alicyclic group-containing acrylic monomers are preferred, and of them, cyclohexyl methacrylate is particularly preferred because it has a stable molecular structure.

Specific examples of the one or more additional monomers include monomers that constitute known resins, such as: nitrogen-containing acrylic monomers including amino group-containing acrylic monomers such as dimethylaminoethyl methacrylate, methylaminoethyl methacrylate, or dimethylaminobutyl methacrylate, and derivatives thereof; acrylic monomers other than those; monomers that constitute olefin resins such as polyethylene or polypropylene; monomers that constitute polyvinyl resins or polyvinylidene resins such as polystyrene resins, polyvinyl alcohol, polyvinyl butyral, polyvinyl chloride, polyvinyl carbazole, polyvinyl ether, or polyvinyl ketone; monomers that constitute straight silicone resins formed from organosiloxane bonds or modified products thereof; monomers that constitute fluorinated resins such as polytetrafluoroethylene, polyvinyl fluoride, polyvinylidene fluoride, or polychlorotrifluoroethylene; monomers that constitute amino resins such as polyurethane resins, phenol resins, urea-formaldehyde resins (urea resins), melamine resins, benzoguanamine resins, or polyamide resins; and monomers that constitute epoxy resins. Among these, nitrogen-containing acrylic monomers are preferable because it is easy for the carrier to hold electrical charges, and of those, the amino group-containing acrylic monomers are preferable, with dimethylamino methacrylate being even more preferable.

The ratio of copolymerization (weight ratio) when synthesizing a copolymer of a monomer having an alicyclic group and one or more additional monomers, that is, the monomer having an alicyclic group: one or more additional monomers, is preferably from 99.5:0.5 (or about 99.5:0.5) to 60:40 (or about 60:40), and is more preferably from 99:1 (or about 99:1) to 80:20 (or about 80:20).

When the proportion of the monomer having an alicyclic group is too large relative to the proportion of the one or more additional monomers so that the ratio is out of the aforementioned range, the coating with the resin is deteriorated due to steric hindrance among the alicyclic groups, or the like, and the resin may peel off from the surface of the carrier particles. When the proportion of the monomer having an alicyclic group is too small relative to the proportion of the one or more additional monomers so that the ratio is out of the aforementioned range, the resin may have poor environmental stability.

Furthermore, as for the resin for coating, a resin mixture of a resin synthesized using a monomer having an alicyclic group (a polymer synthesized using only the monomer having an alicyclic group, and/or a copolymer of the monomer having an alicyclic group and one or more additional monomers) and a resin synthesized without using a monomer having an alicyclic group may be used. In this case, the proportion of the resin synthesized using the monomer having an alicyclic group to the resin mixture is preferably 20% by weight or more, and more preferably 30% by weight or more. A proportion closer to 100% by weight is even more preferable. When the proportion of the resin synthesized using the monomer having an alicyclic group in the resin mixture accounts less than 20% by weight, the hydrophobicity at the surface of the carrier particles is decreased because the number of alicyclic groups included in the resin for coating is too small, and the environmental dependency of the resin on changes in temperature or humidity may be increased.

The combination of the monomers in the copolymer is not particularly limited. However, a combination of cyclohexyl methacrylate and a nitrogen-containing acrylic monomer is preferable, and a combination of cyclohexyl methacrylate and dimethylaminoethyl methacrylate is more preferable. These combinations allow an increase in the adhesiveness of the coating layer to the core material, and may enhance the electrical charging ability while suppressing the environmental dependency. In addition, a copolymer including cyclohexyl methacrylate and a nitrogen-containing acrylic monomer as the monomer components may be prevented from penetrating into the inside of the core material when the specific core material is applied, and the environmental dependency may thus be further improved.

With regard to the ratio of polymerization for the copolymer of cyclohexyl methacrylate and a nitrogen-containing acrylic monomer (particularly, dimethylaminoethyl methacrylate), the content (molar ratio) of the nitrogen-containing acrylic monomer with respect to the total content of the monomers used in the polymerization of the copolymer may be 0.5% by mole to 10% by mole.

The coating layer may include, if necessary, an electroconductive powder for the purpose of controlling the resistance or the like.

Specific examples of the electroconductive powder include: particles of a metal such as gold, silver, or copper; carbon black; Ketjen black; acetylene black; particles of a semi-conductive oxide having a volume resistivity of $10^8$ Ω·cm to $10^{12}$ Ω·cm, such as titanium oxide or zinc oxide; and particles prepared by coating the surface of the particles of titanium oxide, zinc oxide, barium sulfate, aluminum borate, or potassium titanate with tin oxide, carbon black, a metal, or the like. One of them may be used alone, or two or more thereof may be used in combination.

Furthermore, the volume resistivity as used in the invention is the value obtained at 20° C. and 50% RH.

The electroconductive powder is preferably carbon black particles, for being favorable in terms of production stability, costs, electroconductivity or the like.

The type of the carbon black is not particularly limited, but the carbon black may have a DBP oil absorption of 50 ml/100 g to 250 ml/100 g due to its excellent production stability.

The volume average particle size of the electroconductive powder is preferably 0.5 μm or less (or about 0.5 μm or less), more preferably in a range of from 0.05 μm (or about 0.05 μm) to 0.5 μm (or about 0.5 μm), and further more preferably in a range of from 0.05 μm (or about 0.05 μm) to 0.35 μm (or about 0.35 μm). When the volume average particle size is smaller than 0.05 μm, the aggregation property of the electroconductive powder is deteriorated, and the carrier particles tend to have different volume resistivities among them. When the volume average particle size is larger than 0.5 μm, the electroconductive powder may easily fall off from the coating layer, and stable electrical charging ability may not be attained.

The volume average particle size of the electroconductive powder is measured using a laser diffraction type particle size distribution measuring apparatus (trade name: LA-700, manufactured by Horiba, Ltd.).

The measurement is performed as follows. First, 2 g of a test sample is added to 50 ml of a 5% aqueous solution of a surfactant, preferably sodium alkylbenzenesulfonate, and the mixture is subjected to dispersion for 2 minutes with an ultrasonic dispersing machine (1,000 Hz). A sample is thus prepared and is subjected to measurement.

The counts for the respective channels weighted by the particle volume corresponding to the respective channels are accumulated from the smaller volume average particle size side, and the particle size at which the cumulative counts reach 50% of the total counts is taken as the volume average particle size.

The volume resistivity of the electroconductive powder is preferably $10^1$ Ω·cm (or about $10^1$ Ω·cm) to $10^{11}$ Ω·cm (or about $10^{11}$ Ω·cm), and more preferably $10^3$ Ω·cm (or about $10^3$ Ω·cm) to $10^9$ Ω·cm (or about $10^9$ Ω·cm).

The volume resistivity of the electroconductive powder is measured in the same manner as that for the volume resistivity of the core material.

The amount of the electroconductive powder is preferably 0.05% by weight to 1.5% by weight, and more preferably 0.10% by weight to 1.0% by weight with respect to the total amount of the coating layer. When the amount of the electroconductive powder is larger than 1.5% by weight, a decrease in the resistance of the carrier occurs, and defects in the images may occur due to attachment of the carrier to developed images, or the like. On the other hand, when the amount of the electroconductive powder is smaller than 0.05% by weight, the carrier is insulated, and it may be difficult for the carrier to function as a development electrode during the development. In particular, when forming a solid black image, edge effects may occur, and thus the reproducibility of solid images may be deteriorated.

Furthermore, the coating layer may further include resin particles. Examples of the resin particles include thermoplastic resin particles and thermosetting resin particles. Among these, the thermosetting resin particles are preferred from the viewpoint that the hardness thereof is relatively easily increased, and resin particles formed from a nitrogen-containing resin including a nitrogen (N) atom are preferred from the viewpoint of imparting negative electrical charging ability to the toner. In addition, one of these resin particles may be used alone, or two or more thereof may be used in combination.

The volume average particle size of the resin particles is, for example, preferably 0.1 μm to 2.0 μm, and more preferably 0.2 μm to 1.0 μm. When the volume average particle size of the resin particles is less than 0.1 μm, the dispersibility of the resin particles in the coating layer may be extremely poor. When the volume average particle size of the resin particles exceeds 2.0 μm, the resin particles may easily fall off from the coating layer, and the originally intended effects may not be exhibited.

The volume average particle size of the resin particles is determined by a measurement method substantially similar to that for the volume average particle size of the electroconductive powder.

The amount of the resin particles is preferably 1% by volume to 50% by volume, more preferably 1% by volume to 30% by volume, and further more preferably 1% by volume to 20% by volume with respect to the total coating layer. When the amount of the resin particles is smaller than 1% by volume, the effects due to the resin particles may not be exhibited. When the amount of the resin particles exceeds 50% by volume, the resin particles may easily fall off from the coating layer, and stable electrical charging ability may not be obtained.

The total amount of the coating layer in the carrier of the invention is preferably in a range of from 0.5 parts by weight to 10 parts by weight, more preferably 1 part by weight to 5 parts by weight, and particularly preferably 1 part by weight to 3 parts by weight with respect to 100 parts by weight of the magnetic particles. When the amount of the coating layer is smaller than 0.5 parts by weight, the extent of surface exposure of the magnetic particles is excessive, and thus the magnetic particles tend to be under the charging influence of the development electric field. Meanwhile, when the amount of the resin layer is larger than 10 parts by weight, the amount of resin powder that detaches from the coating layer increases, and the developer may include detached carrier resin powder from an early stage.

The coating ratio of the coating layer at the surface of the magnetic particles is preferably 80% or higher, more preferably 85% or higher, and further more preferably substantially 100%. When the coating ratio is less than 80%, if the carrier has been used for a long time, the resistance of the carrier is lowered due to peeling off or the like of the coating resin, and as a result, injection of charge to the carrier occurs. Thus, there are cases where a carrier which has been charge-injected migrates to the photoreceptor, and causes decoloration of images.

The coating ratio of the coating layer is obtained by X-ray photoelectron spectroscopy (XPS) measurement. The measurement is performed with an XPS measuring apparatus JPS80 (trade name, manufactured by JEOL, Ltd.) using a MgKα ray as an X-ray source under the conditions of an acceleration voltage of 10 kV and an emission current of 20 mV. The measurement is conducted on the main element(s) constituting the coating layer (usually carbon), and the main element(s) constituting the magnetic particles (for example, iron and oxygen in the case where the magnetic particles include an iron oxide material such as magnetite). Hereinafter, description will be given assuming that the magnetic particles include iron oxide. Here, a C1s spectrum is measured for the measurement of carbon, an Fe2p3/2 spectrum is measured for the measurement of iron, and an O1s spectrum is measured for the measurement of oxygen.

The respective numbers of atoms of carbon ($A_C$), oxygen ($A_O$) and iron ($A_{Fe}$) are determined on the basis of the respective spectra of these elements. From the ratio of the numbers of the atoms of carbon, oxygen and iron thus obtained, the ratios of iron content in a single magnetic particle and in a single magnetic particle coated with a coating layer (carrier) are determined by the following expression (I). Subsequently, the coating ratio is determined by the following expression (II).

$$\text{Ratio of iron content(atomic \%)}=A_{Fe}/(A_C+A_O+A_{Fe})\times 100 \quad \text{Expression (I)}$$

$$\text{Coating ratio(\%)}=\{1-(\text{ratio of iron content in carrier})/(\text{ratio of iron content in magnetic particle})\}\times 100 \quad \text{Expression (II)}$$

The average film thickness of the respective coating layers is preferably 0.1 μm to 10 μm, more preferably 0.1 μm to 3.0 μm, and particularly preferably 0.1 μm to 1.5 μm. When the average film thickness of the coating layers is thinner than 0.1 μm, there may be a decrease in the resistance due to the peeling off of the coating layer when the carrier is used for a long period of time, and it may become difficult to sufficiently control the pulverization of the carrier. On the other hand, when the average film thickness of the coating layer exceeds 10 μm, it may take a long time to reach charge saturation.

The average film thickness (μm) of the coating layer may be obtained as described below, when the true specific gravity of the magnetic particles is designated as ρ (dimensionless), the volume average particle size of the magnetic particles is designated as d (μm), the average specific gravity of the coating layer is designated as $\rho_C$, and the total amount of the coating layer with respect to 100 parts by weight of the magnetic particles is designated as $W_C$ (parts by weight).

$$\text{Average film thickness(μm)}=[\text{Amount of coating resin (including all additives such as electroconductive agents) per one carrier particle/Surface area per one carrier particle}]\div\text{Average specific gravity of coating layer}=[4/3\pi\cdot(d/2)^3\cdot\rho\cdot W_C]/[4\pi\cdot(d/2)^2]\div\rho_C=(1/6)\cdot(d\cdot\rho\cdot W_C/\rho_C)$$

The magnetic particles in the carrier of the invention are not particularly limited as long as they satisfy the conditions described above. Examples of the materials for the magnetic particles include: magnetic metals such as iron, steel, nickel or cobalt; magnetic oxides such as ferrite and magnetite; and glass beads. In particular, ferrite particles are used as the magnetic particles in exemplary embodiments of the invention, because they may easily provided with uniform surfaces and stable electrical charging properties.

The magnetic particles are formed by granulation and sintering. The particles may be finely pulverized as a pretreatment. The pulverization method is not particularly limited, and pulverization may be conducted according to known pulverization methods. Specific examples thereof include methods using a mortar, a ball mill, a jet mill or the like. The final state of pulverization in the pretreatment may vary depending on the material of the particles or the like. However, the volume average particle size of the particles may be 2 μm to 10 μm. When the volume average particle size is less than 2 μm, the desired particle size may not be obtained. When the volume average particle size exceeds 10 μm, the particle size may be excessively large, or the degree of circularity may be small.

The sintering temperature is preferably adjusted to be lower than those used in conventional sintering. Specifically, although the sintering temperature may vary depending on the material to be used, the temperature is preferably 500° C. to 1,200° C., and more preferably 600° C. to 1,000° C. When the sintering temperature is lower than 500° C., the magnetic force necessary for the carrier may not be obtained. When the sintering temperature exceeds 1,200° C., crystals grow rapidly, and the internal structure may tend to be non-uniform, resulting in possibility of cracks and chips.

In order to keep the sintering temperature low, preliminary sintering in the sintering process may be performed in a stepwise manner. Therefore, the entire sintering process may take a sufficiently long period of time.

Regarding the magnetic force of the magnetic particles, a saturation magnetization of the magnetic particles is preferably 50 emu/g or greater, and more preferably 60 emu/g or greater, in a field of 1,000 Oersted. When the saturation magnetization is lower than 50 emu/g, the carrier may be developed on the photoreceptor, together with the toner.

For the measurement of magnetic characteristics, a vibrating sample magnetometer, VSMP10-15 (trade name, manufactured by Toei Industry Co., Ltd.) is used. The test sample is packed in a cell having an internal diameter of 7 mm and a height of 5 mm, and the cell is mounted on the apparatus. A magnetic field is applied to the test sample, and the magnetic field is swept to a maximum of 1,000 Oersted. Subsequently, the applied magnetic field is reduced, and a hysteresis curve is plotted on a recording paper. By using the curve data, the saturation magnetization, the residual magnetization, and the retention force are determined. In exemplary embodiments of the invention, the saturation magnetization represents the magnetization value measured in a magnetic field of 1,000 Oersted.

The volume resistivity of the magnetic particles is preferably in a range of from $10^5$ Ω·cm to $10^{9.5}$ Ω·cm, and more preferably in a range of from $10^7$ Ω·cm to $10^9$ Ω·cm. When the volume resistivity is smaller than $10^5$ Ω·cm, when the toner concentration in the developer is decreased because of repeated copying, charge injection occurs to the carrier, and the carrier itself may be developed. On the other hand, when the volume resistivity is greater than $10^{9.5}$ Ω·cm, the image quality may be adversely influenced by a significant edge effect, pseudo-contours, or the like.

The volume resistivity (Ω·cm) of the magnetic particles is measured in the following manner. In this case, the measurement is performed under a temperature of 20° C. and a humidity of 50% RH.

On the surface of a circular jig on which a 20-$cm^2$ electrode plate is disposed, an object of measurement is mounted linearly to form a layer having a thickness of about 1 to 3 mm. Another 20-$cm^2$ electrode plate is mounted thereon so that the layer is interposed between the electrode plates. In order to eliminate any spaces among the particles of the object of measurement, a load of 4 kg is placed on the electrode plate mounted on the layer, and the thickness (cm) of the layer is then measured. The electrodes on and under the layer are respectively connected to an electrometer and a high voltage power supply device. A high voltage is applied to the electrodes to generate an electric field of $10^{3.8}$ V/cm, and the current value (A) flowing at this time point is read. Subsequently, the volume resistivity (Ω·cm) of the object of measurement is calculated. The expression for calculation of the volume resistivity (Ω·cm) of the object of measurement is as follows.

$$R=E\times 20/(I-I_0)/L \quad \text{Expression}$$

In the expression, R represents the volume resistivity (Ω·cm) of the object of measurement, E represents the applied voltage (V), I represents the current value (A), $I_0$ represents the current value (A) at an applied voltage of 0 V, and L represents the thickness (cm) of the layer. The coefficient of 20 represents the area ($cm^2$) of each of the electrode plates.

With regard to the carrier of the invention, as a method of controlling the difference in the BET specific surface areas according to the invention to fall in a range of from 0.0300 $m^2/g$ to 0.400 $m^2/g$, there is a method of reducing the burden to the carrier during production by using, as the resin used in the coating layer, a copolymer of a monomer having a polar group and a monomer not having a polar group. Specifically, when a carrier is produced using a kneader, the difference in the BET specific surface area may be controlled to fall within the above-described range, by stirring the material at a low speed under substantially vacuum conditions.

Developer for Electrostatic Latent Image Development

The developer for electrostatic latent image development of the invention (hereinafter, sometimes referred to as "developer of the invention") includes at least a toner including toner particles, and the carrier particles for developing an electrostatic latent image of the invention.

The toner used in the invention is not particularly limited as long as it is a toner including a colorant, and any known toner may be used. For example, a colored toner including a binding resin and a colorant may be used. It is possible to use a toner including a colorant, and having a shape factor of 100 (or about 100) to 130 (or about 130), a volume average particle size of 3.0 μm (or about 3.0 μm) to 6.5 μm (or about 6.5 μm), and a particle size distribution on the fine particles side of 1.30 or less (or about 1.30 or less).

When the toner, which includes a colorant, and has a shape factor of 100 to 130, a volume average particle size of 3.0 μm to 6.5 μm, and a particle size distribution on the fine particles side of 1.30 or less (hereinafter, sometimes referred to as "specific toner"), is used in combination with the carrier of the invention as described above, the charging ability is not decreased, clear images are obtained even at low image densities, and at the same time, unevenness in concentration may be prevented even under low temperature and low humidity conditions.

First, the specific toner will be described.

The shape factor of the specific toner is typically 100 to 130, and preferably 100 to 125. When the shape factor of the specific toner exceeds 130, the contact area between the toner and the carrier increases, and thus unevenness in concentration may occur. Particularly, since the toner concentration in the developer increases under low temperature and low humidity conditions, this phenomenon may become more prominent.

When toner particles having a shape factor of 130 or more (or about 130 or more) are included in addition to the specific toner, the ratio thereof is preferably 10% or less (or about 10% or less), and more preferably 5% or less (or about 5% or less) with respect to the total number of toner particles. When the ratio of the particles having a shape factor of 130 or more exceeds 10%, the toner may remain on the photoreceptor, resulting in deterioration of the transfer rate.

According to the invention, the shape factor of the toner is determined by the following expression:

$$\text{Shape factor}=100\pi\times(ML)^2/(4\times A)$$

wherein ML represents the maximum length of the toner particles, and A is the surface area of the toner particles. The shape factor of the toner may be calculated in the following manner. An optical microscopic image of a toner dispersed on a glass slide is captured into an image analyzer (registered trade name: LUZEX III, manufactured by Nireco Corporation) through a video camera, then the maximum lengths and projected areas of 100 or more toner particles are respectively determined, the shape factor of each particle is obtained by the above expression, and the average value thereof is then determined.

The volume average particle size of the specific toner particles is typically 3.0 μm (or about 3.0 μm) to 6.5 μm (or about 6.5 μm), and preferably 4.0 μm (or about 4.0 μm) to 6.0 μm (or about 6.0 μm). When the volume average particle size of the specific toner is less than 3.0 μm, the electrostatic adhesive force per one toner particle may be increased, and thus transferability may deteriorate. Meanwhile, when the volume average particle size exceeds 6.5 μm, image reproducibility may deteriorate. In the invention, a volume cumulative distribution with regard to the volume particle size distribution measured by a coulter counter (manufactured by Coulter, Inc.) is plotted from the large particle diameter side, and the particle size obtained when the volume cumulative ratio reaches 50% of the total cumulative volume, is taken as the volume average particle size ($D_{50v}$), which is taken as the volume average particle size of the toner.

The particle size distribution on the fine particles side of the specific toner is typically 1.30 or less (or about 1.30 or less), and preferably 1.25 or less (or about 1.25 or less). When the particle size distribution on the fine particles side exceeds 1.30, charge distribution may occur at the toner, and fine particles may remain on the photoreceptor and transferability may deteriorate.

Furthermore, the specific toner preferably has a particle size distribution on the coarse particles side of 1.40 or less, and more preferably 1.30 or less, from the viewpoint of preventing clouding.

The particle size distributions on the coarse/fine particles sides of the toner in the invention are determined by the following expressions:

Particle size distribution on the fine particles side=Number average particle size($D50p$)/84% Number particle size($D84p$)

Particle size distribution on the coarse particles side=16% volume particle size($D16v$)/Volume average particle size($D50v$)

In the expressions, the number average particle size (D50p) is defined as the particle size obtained by plotting a cumulative distribution with regard to the number particle size distribution measured with a coulter counter (manufactured by Coulter, Inc.) from the large particle diameter side, and taking the particle size obtained at a cumulative value of 50%, and the 84% number particle size (D84p) is defined as the particle size obtained at a cumulative value of 84%.

The volume average particle size (D50v) is defined as the particle size obtained by plotting a cumulative distribution with regard to the volume particle size distribution measured with a coulter counter (manufactured by Coulter, Inc.) from the large particle diameter side, and taking the particle size obtained at a cumulative value of 50%, and the 16% volume particle size (D16v) is defined as the particle size obtained at a cumulative value of 16%.

Hereinafter, the toner according to the invention including the specific toner will be described.

The toners according to the invention may be produced in any methods including kneading-pulverization, suspension polymerization, solubilization dispersion, emulsion aggregation coalescence, and the like. However, the emulsion aggregation coalescence method is more preferable, as the toners obtained thereby have a narrower grain size distribution, and the requirement for a classification operation can be eliminated in some cases. Further, this method is more preferable from the viewpoint of controllability of toner shape and toner surface properties.

In the emulsion aggregation coalescence method: at least a resin microparticle dispersion liquid prepared by dispersing resin microparticles produced by emulsion polymerization or the like, a colorant particle dispersion liquid, and a release agent dispersion liquid are mixed; the resultant mixture is subjected to heating, or to heating and adjustment of pH of the dispersion liquid and/or addition of an aggregation agent (at least to heating) to aggregate the particles to the size of toner particles, to thereby obtain aggregated particles; the resultant product is heated to a temperature higher than the glass transition temperature of the resin microparticles, to allow the aggregated particles to fuse and form toner particles.

During the aggregation process, an inorganic oxide may be added for the purpose of imparting resin elasticity, an additive such as a dispersion liquid including a charge controlling agent may be added for the purpose of controlling the electrical charge, or a resin microparticle dispersion liquid may be added for the purpose of preventing the exposure of a colorant, a release agent, or the like to the surface of the toner particles. In particular, the method including attaching and fusing a resin microparticle dispersion liquid is suitable because the surface exposure to a colorant or a release agent may be reduced, and the fluidity of the toner or the dependency of the electrical charge on the environment may be prevented.

The resin to be used in the resin particles is not particularly limited. Specific examples thereof include polymers of the following monomers: styrenes such as styrene, p-chlorostyrene and α-methylstyrene; esters each having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitrites such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; and olefins such as ethylene, propylene and butadiene. Moreover, a cross-linking component, for example, acrylic ester such as pentanediol diacrylate, hexanediol diacrylate, decanediol diacrylate or nonanediol diacrylate may be used.

In addition to the polymers of these monomers, there may be used copolymers obtained by a combination of two or more of the monomers, or mixtures of such copolymers, as well as non-vinyl condensed resins such as epoxy resins, polyester resins, polyurethane resins, polyamide resins, cellulose resins and polyether resins, or mixtures of these with the aforementioned vinylic resins, or graft polymers obtained by polymerizing the vinylic monomers in the co-presence of such non-vinyl resins.

The resin microparticle dispersion liquids to be used in the invention are easily prepared by the emulsion polymerization coalescence method or by a similar polymerization method employing a heterogeneous dispersion. Alternatively, such dispersion liquids may be prepared by any other methods, including those wherein a homogeneous polymer, previously prepared by solution polymerization, mass polymerization, or the like, is added together with a stabilizer into a solvent that does not dissolve the polymer, followed by mechanical mixing and dispersing.

For example, in the case of the vinyl monomers, a resin microparticle dispersion liquid may be prepared by performing emulsion polymerization or suspension polymerization depending on the selected preparation method, using an ionic surfactant or the like. Meanwhile, in the case of using a resin which is oily and is capable of being dissolved in a solvent having a relatively low solubility in water, a resin microparticle dispersion liquid may be prepared by dissolving the resin in such a solvent, dispersing the resultant mixture in water together with an ionic surfactant or a polymer electrolyte by using a dispersing machine such as a homogenizer, and then heating or reducing the pressure to evaporate the solvent.

Examples of the surfactant include, but not particularly limited to: anionic surfactants such as sulfuric acid esters, sulfonates, phosphoric acid esters or soaps; cationic surfactants such as amine salts or quaternary ammonium salts; nonionic surfactants such as polyethylene glycols, alkylphenol ethylene oxide adducts, alkyl alcohol ethylene oxide adducts and polyhydric alcohols; and various graft polymers.

In the case of preparing a resin microparticle dispersion liquid by emulsion polymerization, it is preferable to add a small amount of an unsaturated acid such as acrylic acid, methacrylic acid, maleic acid or styrenesulfonic acid because a protective colloid layer may be formed, and soap-free polymerization may be carried out.

The glass transition temperature of the resin microparticles to be used in the invention is preferably in a range of from 45° C. to 65° C., more preferably in a range of from 50° C. to 60° C., and further more preferably in a range of from 53° C. to 60° C. When the glass transition temperature is lower than 45° C., blocking of the toner powder may easily occur under heating. When the glass transition temperature is 65° C. or more, the fixing temperature may be too high.

Examples of the colorants to be used in the invention include: various pigments such as carbon black, chromium yellow, Hanza Yellow, benzidine yellow, threne yellow, quinoline yellow, permanent yellow, Permanent Orange GTR, pyrazolone orange, Vulcan Orange, Watchung Red, Permanent Red, Brilliant Carmine 3B, Brilliant Carmine 6B, DuPont Oil Red, pyrazolone red, Lithol Red, Rhodamine B Lake, Lake Red C, rose bengal, aniline blue, ultramarine blue, Calco Oil Blue, methylene blue chloride, phthalocyanine blue, phthalocyanine green, and malachite green oxalate; and various dyes such as acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, triphenylmethane dyes, diphenylmethane dyes, thiazine dyes, thiazole dyes, and xanthene dyes. One of these colorants may be used alone, or two or more thereof may be used in combination.

Any common dispersing means, including rotary-shearing homogenizers and dispersers using a dispersion medium such as a ball mill, a sand mill, a Dyno-mill, and an ultimizer, may be used for dispersing the colorant, and thus the dispersion method is not particularly restricted.

Specifically, the colorant is dispersed in water together with an ionic surfactant and a polymer electrolyte such as a polymeric acid or a polymeric base. The volume average particle size of the dispersed colorant particles may be 1 μm or less. A volume average particle size in a range of from 80 nm to 500 nm may be used from the viewpoint that the dispersion state of the colorant in the toner is favorable without impairing the aggregation property.

The volume average particle sizes as described above may be measured by using, for example, a laser diffraction type particle size distribution measuring apparatus or a centrifuge type particle size distribution measuring apparatus.

The release agent may be dispersed in water together with an ionic surfactant and a polymer electrolyte such as a polymeric acid or a polymeric base, and the resultant dispersion liquid may be heated to a temperature higher than the melting temperature of the release agent and stirred with a homogenizer or a pressure-discharging distributor capable of applying strong shearing force so as to produce a release agent dispersion liquid in which release agent particles having a volume-average particle diameter of 1 μm or less are dispersed.

The volume average particle diameter of the release agent particles is more preferably in a range of from 100 nm to 500 nm. When the volume average particle diameter is less than 100 nm, it generally becomes more difficult for the release agent to be incorporated into the toner, although it depends on the properties of the resin to be used. Meanwhile, when it is more than 500 nm, it may be less easy to get a good dispersion state of the release agent in the toner. These release agent particles may be added together with other resin microparticle components into a mixing solvent all at once or gradually in aliquots.

Any known release agent may be used as the release agent used in the invention. Examples of the release agent include: low molecular weight polyolefins such as polyethylene, polypropylene and polybutene; silicones which show softening temperature when heated; fatty acid amides such as oleic acid amide, erucic acid amide, ricinoleic acid amide and stearic acid amide; plant waxes such as carnauba wax, rice wax, candelilla wax, wood wax and jojoba oil; animal waxes such as beeswax; mineral waxes, petroleum waxes or synthetic waxes, such as Montan wax, ozokerite, ceresin, paraffin wax, microcrystalline wax, and Fischer-Tropsch wax; and modified products thereof.

Among these known release agents, polyolefin waxes each having a melting temperature in a range of from 75° C. (or about 75° C.) to 105° C. (or about 105° C.) are preferably used, and, of those, a paraffin wax or a polyethylene wax is particularly preferably used because the fixing properties, or more specifically, the offset properties in the high temperature region, are significantly improved. That is, when a paraffin wax or a polyethylene wax is used, the toner system exhibits excellent offset properties in the high temperature region in a wide range from low speed processes (80 to 250 mm/sec) to high speed processes (250 to 500 mm/sec), and thus these waxes are favorably used. The width of the molecular weight distribution may be freely narrowed by molecular distillation.

A melting temperature of the release agent below 75° C. may cause a decrease in concentration caused by decreased toner dispensing properties due to deterioration of storage properties and fluidity of the toner, or image defects such as shrinkage (white streaks) in the trimmer caused by toner solidification. When the melting temperature of the release agent exceeds 105° C., the release agent is not compatible with all processing speed ranges from low to high speeds, as with when using an inappropriate kind of release agent, and also since the release agent poorly exudes to the fixed surface, offset at high temperature may occur.

The amount of the release agent to be added is preferably in a range of from 5 to 20% by weight, more preferably in a range of from 7 to 13% by weight, with respect to the total amount of the toner. An added amount of less than 5% by weight may lead to the occurrence of high-temperature offsets, while an added amount exceeding 20% by weight may lead to a decrease in toner fluidity, even when the surface of the release agent is covered by a binder resin.

The aggregation agent to be used in the invention may be a surfactant having a charge opposite to that of the surfactant used in the resin microparticle dispersion liquid and colored particle dispersion liquid, or preferably a bivalent or higher-valent inorganic metal salt. Inorganic metal salts are particularly favorable, as they allow a reduction in the amount of surfactants used and an improvement in the electrostatic properties of the resulting toner.

Examples of the inorganic metal salts include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. In particular, aluminum salts and the polymers thereof are preferable among them. For obtaining a narrower grain size distribution, it is possible to use a higher-valent inorganic metal salt, i.e., bivalent is better than monovalent, trivalent is better than bivalent, tetravalent is better than trivalent; and a polymeric inorganic metal salt polymer is more preferable when the valency is the same.

The amount of the aggregation agent to be added may vary depending on the ion concentration during the aggregation. However, in general, the solid content (toner component) in the solution mixture is preferably in a range of from 0.05 to 1.00% by weight, and more preferably in a range of from 0.10 to 0.50% by weight. When the amount is less than 0.05% by weight, the effect of the aggregation agent is hardly exerted. When the amount is more than 1.00% by weight, excessive aggregation may occur, and a large amount of aggregated powder of toner may be generated, resulting in image defects caused by inferior transferability.

A toner having such properties may be prepared, for example, as follows.

Specifically, in the emulsion aggregation coalescence method, at least the resin microparticles, the release agent particles and the colorant particles are aggregated by means of heating, or by means of heating and adjustment of pH of the dispersion liquid and/or addition of an aggregation agent (at least by heating). After that, the particle size is stabilized by pH adjustment, and the temperature is increased to a temperature at or above the glass transition temperature (Tg) of the resin microparticles, to fuse the particles. At that time, a desired shape of the toner particles and toner surface properties may be obtained by adjusting the fusion temperature Tf, the fusion time t, and pH.

In other words, in the emulsion aggregation coalescence method, the toner shape may simply be controlled by pH adjustment, and the toner surface properties may be controlled by controlling the fusion temperature and fusion time. However, with regard to the toner surface properties, the fusion temperature and fusion time for obtaining desired surface properties may vary depending on the melting temperature of the release agent to be used. Therefore, it is possible to appropriately prepare a toner having the specific properties described above, by controlling the fusion temperature and fusion time depending on the melting temperature of the release agent used.

As described above, the fused particles are subjected to a solid-liquid separation process such as filtration, and optionally a washing process and a drying process to produce toner particles. In order to secure electrical charging ability and reliability which the toner is required to have, the fused particles may be fully washed.

For example, when particles are washed with an acid solution such as nitric acid, sulfuric acid, or hydrochloric acid, or an alkaline solution such as sodium hydroxide, and additionally washed with ion-exchange water or the like, the effect of the washing is extremely large. Any one of the drying methods commonly practiced including vibratory fluidized bed drying, spray drying, freeze drying, and flash jet drying, and the like may be used in the drying. The toner particles preferably have a water content of 2% by weight or less, more preferably 1% by weight or less after drying.

On the other hand, when the toner is produced by a kneading-pulverization method, first, the resin described in the emulsion aggregation coalescence method, a colorant, and a release agent are mixed with a mixer such as a NAUTA MIXER®, a Henschel mixer, or the like. The resultant mixture is kneaded by a uniaxial or biaxial extruder. After the mixture kneaded is rolled and cooled, the mixture is finely pulverized by a mechanical or air current pulverizer such as I-type mill, KTM or a jet mill, and the resultant particles are classified by a classifier using Coanda effect, such as an elbow jet, or by an air classifier such as turbo crash fire and accu cut.

The toner according to the invention can be produced by controlling the toner surface structure. For example, the toner surface can be controlled, when the Elbow Jet mill is used, by adjusting the air pressure in the raw material-supply port, or when an air classifier is used, by adjusting the rotational frequency of the rotor and the temperature of the air supplied into the classifier. An inorganic oxide or the like may be additionally added externally as required in a similar manner to the emulsion aggregation coalescence process, and the particles may be screened or the like, and larger particles therein may be removed as required.

For the purpose of enhancing the electrical charging ability, fluidity or cleaning properties of the toner, the obtained toner particles may be added with an external additive such as: an inorganic fine powder; an organic fine powder of a fatty acid or a derivative or a metal salt thereof; or resin microparticles such as microparticles of a fluorinated resin or polyethylene, a fine powder of an acrylic resin, or a resin fine powder of a higher alcohol powder.

Examples of the inorganic oxides used as the external additive include common inorganic oxides such as titania, titanium compounds, silica, alumina and tin oxide. For the purpose of imparting electrical charging ability, reducing the environmental dependency, or imparting the admixing properties, the surface of the inorganic oxides may be treated with a silane compound such as a silane coupling agent.

As for the silane compound, any of chlorosilanes, alkoxysilanes, silazanes and silylating agents may be used. Specific examples of the silane compound include methyltrichlorosilane, methyldichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltrimethoxysilane, dimethyldimethoxysilane, phenyltriethoxysilane, diphenyldiethoxysilane, isobutyltriethoxysilane, decyltriethoxysilane, hexamethyldisilazane, N,O-(bistrimethylsilyl) acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxychlorohexyl)ethyltrimethoxysilane, γ-glycidoxypropyltrimethoxysilane, γ-glycidoxypropylmethyldiethoxysilane, γ-mercaptopropyltrimethoxysilane, mercaptopropyltrimethoxysilane, and γ-chloropropyltrimethoxysilane. However, the silane compound is not limited thereto.

The addition of the external additive to the surface of the toner particles is performed by using, for example, a V-shaped blender, a Henschel mixer, a Redige mixer or the like.

The mixing ratio by weight of the toner and the carrier (toner weight/carrier weight) in the developer of the invention is preferably in a range of from 0.01 to 0.3, and more preferably in a range of from 0.03 to 0.2.

Image forming method, developer cartridge for electrostatic latent image development, image forming apparatus, and process cartridge The image forming method of the invention includes at least charging the surface of an electrostatic latent image holding member (charging process), forming an electrostatic latent image on the surface of the charged electrostatic latent image holding member (electrostatic latent image forming process), developing the electrostatic latent image formed on the surface of the electrostatic latent image holding member to form a toner image (toner image forming process), transferring the toner image to a recording medium (transferring process), and fixing the toner image transferred to the recording medium (fixing process), and is characterized in that the developer is the developer of the invention. In addition to these processes, the image forming method of the invention may also include other processes such as a cleaning process.

The respective processes in the image forming method of the invention may be carried out by conventionally known methods. Further, the toner image forming process is preferably a process as described below, which includes forming a toner image by developing an electrostatic latent image formed on the surface of the electrostatic latent image holding member using the developer held by the developer holding member, wherein the surface roughness Ra of the developer holding member is in a range of from 0.01 (or about 0.01) to 1.0 (or about 1.0).

The developer cartridge for electrostatic latent image development of the invention (hereinafter, may be simply referred to as cartridge) will be described. The cartridge of the invention at least holds the developer which is to be supplied to a toner image forming unit that develops an electrostatic latent image formed on the surface of the electrostatic latent image holding member to form a toner image, and is characterized in that the developer is the developer of the invention.

Therefore, when the cartridge of the invention, which holds the developer of the invention, is used in an image forming apparatus to which the cartridge is removably attached, clear images may be obtained even at low image densities, without a decrease in the charging ability.

The image forming apparatus of the invention includes an electrostatic latent image holding member, a charging unit that electrically charges the surface of the electrostatic latent image holding member, an electrostatic latent image forming unit that forms an electrostatic latent image on the surface of the charged electrostatic latent image holding member, a toner image forming unit that forms a toner image by developing the electrostatic latent image formed on the electrostatic latent image holding member by using a developer, a transfer unit that transfers the toner image to a recording medium, and a fixing unit that fixes the toner image onto the recording medium, and is characterized in that the developer is the developer for developer for electrostatic latent image development of the invention.

In addition, the image forming apparatus of the invention is not particularly limited as long as the apparatus includes at least the electrostatic latent image holding member, the electrostatic latent image forming unit, the toner image forming unit, the transfer unit, and the fixing unit, but may further include one or more additional units such as a cleaning unit, a charge eliminating unit, or the like, if necessary.

The toner image forming unit includes at least a developer holding member that supplies a developer to the surface of the electrostatic latent image holding member as described in the section for the image layer forming method of the invention, and the surface roughness Ra of the developer holding member is preferably in a range of from 0.01 to 1.0. The developer holding member described in the section for the image layer forming method of the invention is an example of a developer holding member.

The process cartridge of the invention includes at least an electrostatic latent image holding member and a toner image forming unit that holds the developer of the invention and forms a toner image by developing the electrostatic latent image formed on the surface of the electrostatic latent image holding member by using a developer, the process cartridge being removably attached to an image forming apparatus. The process cartridge of the invention may further include one or more other members such as a charge eliminating unit, if necessary.

Hereinafter, the developer cartridge for electrostatic latent image development, the image forming apparatus and the process cartridge of the invention will be described in detail with reference to the drawings.

FIG. 1 is a cross-sectional view schematically showing the configuration of an exemplary embodiment (first exemplary embodiment) of the image forming apparatus of the invention. The image forming apparatus shown in FIG. 1 includes a cartridge of the invention.

The image forming apparatus 10 shown in FIG. 1 includes an electrostatic latent image holding member 12, a charging unit 14, an electrostatic latent image forming unit 16, a toner image forming unit 18, a transfer unit 20, a cleaning member 22, a charge eliminating unit 24, a fixing unit 26, and a cartridge 28.

The developer contained in the toner image forming unit 18 and in the cartridge 28 is the developer of the invention.

FIG. 1 shows, for convenience, a configuration including one toner image forming unit 18 and one cartridge 28 each of which contains the developer of the invention. However, for example, in the case of a color image forming apparatus or the like, a configuration including plural toner image forming units 18 and plural cartridges 28 in numbers corresponding to the number of the image forming apparatuses, is also possible.

The image forming apparatus shown in FIG. 1 is an image forming apparatus having a configuration to which the cartridge 28 is removably attached, in which the cartridge 28 is connected to the toner image forming unit 18 through a developer supply pipe 30. Upon image formation, the developer of the invention contained in the cartridge 28 is supplied to the toner image forming unit 18 through the developer supply pipe 30, and images may thus be formed for a long time period using the developer of the invention. When the amount of the developer held in the cartridge 28 reduces, this cartridge 28 may be replaced with a new cartridge.

In the surroundings of the electrostatic latent image holding member 12, there are disposed, in an order following the direction of rotation (direction of arrow A) of the electrostatic latent image holding member 12: a charging unit 14 that electrically charges the surface of the electrostatic latent image holding member 12 uniformly; an electrostatic latent image forming unit 16 that forms an electrostatic latent image on the surface of the electrostatic latent image holding member 12 in accordance with the image information; a toner image forming unit 18 that supplies the developer of the invention to the formed electrostatic latent image; a drum-shaped transfer unit 20 which is disposed in contact with the surface of the electrostatic latent image holding member 12, and is capable of rotating along the direction of arrow B concomitantly with the rotation of the electrostatic latent image holding member 12 in the direction of arrow A; a cleaning apparatus 22 disposed in contact with the surface of the electrostatic latent image holding member 12; and a charge eliminating unit 24 that eliminates electrical charges from the surface of the electrostatic latent image holding member 12.

A recording medium 50, which is conveyed in the direction of arrow C by a conveying unit (not shown) from the upstream side, can pass through between the electrostatic latent image holding member 12 and the transfer unit 20. The fixing unit 26 equipped with a heating source (not shown) is disposed at the downstream side in the direction shown by arrow C with respect to the electrostatic latent image holding member 12, and a pressure contacting portion 32 is present in the fixing unit 26. The recording medium 50 which has passed through between the electrostatic latent image holding member 12 and the transfer unit 20 can be passed through the pressure contacting portion 32 in the direction of arrow C.

As for the electrostatic latent image holding member 12, for example, a photoreceptor or a dielectric recording body may be used.

Examples of the photoreceptor to be used include a photoreceptor having a single layer structure, a photoreceptor having a multilayer structure, and the like. The photoreceptor may be, for example, an inorganic photoreceptor made of selenium, amorphous silicon, or the like, or an organic photoreceptor.

Examples of the charging unit 14 include known charging units such as: a contacting charging apparatus using a conductive or semi-conductive roller, brush, film, rubber blade or the like; and a non-contacting type charging apparatus involving corotron charging, scorotron charging, or the like, which utilizes corona discharge.

The electrostatic latent image forming unit 16 may be an exposure unit or any conventionally known unit that can form signals that are capable of forming a toner image at a desired position on the surface of a recording medium.

Examples of the exposure unit include conventionally known exposure units such as a combination of a semiconductor laser and a scanning apparatus; an optical laser scanning writing apparatus; or an LED head. In order to realize formation of an exposed image with uniformity and high resolution, it is possible to use a laser scanning writing apparatus or an LED head.

Specific examples of the transfer unit 20 include conventionally known units such as: a unit that applies an electric field between the electrostatic latent image holding member 12 and the recording medium 50 by using a voltage-applied, conductive or semi-conductive roller, brush, film or rubber blade, so as to transfer a toner image formed of electrically charged toner particles; and a unit that performs corona charging of the backside of the recording medium with a corotron charging device or a scorotron charging device which utilize corona discharge, so as to transfer a toner image formed of charged toner particles.

A secondary transfer unit may also be used as the transfer unit 20. Although not shown in the drawing, the secondary transfer unit is a unit that transfers a toner image to an intermediate transfer body, and then conduct secondary transfer of the toner image from the intermediate transfer body to the recording medium 50.

Examples of the cleaning member 22 include a cleaning blade and a cleaning brush.

Examples of the charge eliminating unit 24 include a tungsten lamp and an LED.

Examples of the fixing unit 26 include a thermal fixer that fixes a toner image under heating and pressurizing by means of a heating roller, a pressure roller, and the like, and a flash fuser that thermally fixes a toner image by light irradiation with a flash lamp or the like.

Examples of the material of the roller surface of the heating roller, the pressure roller, or the like include preferably a material having excellent releasability against the toner, a silicone rubber, a fluorinated resin, and the like, from the viewpoint of preventing the adhesion of the toner. In this case, a releasable liquid such as silicone oil may not be applied on both surfaces of the roller. The releasable liquid is effective in widening the fixing latitude, but since the releasable liquid is transferred to the recording medium to be fixed, there may be problems in, for example, that the printed product with an image formed thereon may acquire stickiness, making it impossible to attach tape thereon, or to write letters thereon with a marker pen. These problems become more significant when using a film such as an OHP film as the recording medium. Furthermore, since it is difficult to smoothen the roughness of the surface of fixed images by using the releasable liquid, this may cause a decrease in the transparency of the images, which property is a particularly important factor in the case of using OHP films as the recording medium. However, when the toner includes wax (an offset preventive agent), the toner shows a sufficient fixing latitude, and thus a releasable liquid that is to be applied on the fixing roll, such as silicone oil, is not needed.

The recording medium 50 is not particularly limited, and conventionally known media, including plain paper, gloss paper and the like, may be used. A recording medium having a substrate and an image receiving layer formed on the substrate may also be used.

The toner image forming unit is preferably a unit that forms a thin layer of toner on the rotating cylindrical body of the developer holding member (hereinafter, may also be referred to as "developing roll") 33 by means of a layer regulating unit such as an elastic blade, conveys the thin layer of toner to the developing section, disposes the developing roll and a latent image holding member which holds an electrostatic latent image at the developing section, to be in contact with each other or at a certain distance from each other, and develops the electrostatic latent image with the toner while applying a bias in between the developing roll and the latent image holding member.

As the developer holding member 33, a cylindrical substrate made of a known material such as aluminum or stainless steel may be used. Specifically, a product produced by subjecting a cylindrical object obtained by drawing aluminum or the like, to centerless polishing and a blast treatment with glass beads or sand, and to surface roughening by imparting unevenness to the substrate surface, or the like, may be used, and the developer holding member may be formed from a zinc (Zn) film. For example, an aluminum (Al) tube having a Zn film that has been formed on the surface thereof by chemical plating, or the like is used. In particular, a product obtained by providing a molybdenum-based coating film including molybdenum (Mo), oxygen (O) and hydrogen (H) on such a substrate, is preferred.

A Mo coating film on the substrate may be formed by a chemical conversion treatment using a solution including a molybdenum acid salt. The method of treatment includes two major processes of a cathodic electrolytic treatment process and a drying process. In the cathodic electrolytic treatment process, a gelatinous film of double salt colloid including Mo, O, and H as the components is formed on the substrate, and subsequently, in the drying process, this gelatinous film is hardened by drying. The thickness of the resultant Mo coating film may be appropriately changed by changing the treatment time.

The thickness of the coating film formed on the developer holding member 33 is preferably in a range of from 0.8 μm to 10 μm, or particularly preferably about 3.0 μm from the viewpoint of suppressing the occurrence of development ghost.

When the crack width of the coating film on the developer holding member is 3.0 μm or less, the development ghost may be suppressed for a long period of time. The crack width may be suppressed by controlling the temperature of the drying process.

The surface roughness Ra of the developer holding member is preferably in a range of from 0.01 (or about 0.01) to 1.0 (or about 1.0), more preferably 0.03 (or about 0.03) to 0.9 (or about 0.9), and particularly preferably 0.05 (or about 0.05) to 0.8 (or about 0.8). When Ra is in a range of from 0.01 to 1.0, a decrease in the electrical charge on the developer holding member is prevented, and clear images are obtained. On the other hand, when Ra is smaller than 0.01, the developer is not held stably on the developer holding member, and the density may decrease. When Ra exceeds 1.0, the amount of electrical charge in the developer is decreased due to the moisture present on the developer holding member, and there may be unevenness in the amount of electrical charge and unevenness in the density. The surface roughness Ra may be adjusted by subjecting the substrate to centerless polishing and a blast treatment with glass beads or sand. Further, the surface roughness Ra of the developer holding member is an arithmetic average roughness, which is one of the indices for roughness, and is determined by measuring with a known stylus profilometer (stylus surface roughness measuring instrument) (for example, trade name: SURFCOM 1400A, manufactured by Tokyo Seimitsu Co., Ltd.).

Image formation using the image forming apparatus 10 will be described. First, the surface of the electrostatic latent image holding member 12 is electrically charged by the charging unit 14 while the electrostatic latent image holding member 12 is rotated in the direction of arrow A (charging process), and an electrostatic latent image is formed on the surface of the charged electrostatic latent image holding member 12 by the electrostatic latent image forming unit 16 in accordance with image information (electrostatic latent image forming process).

Meanwhile, a thin layer of toner is formed by the toner image forming unit 18 having a layer forming blade 35 which is coated with a nitrogen-containing material or the like and is in contact with the developing roll 33 at a uniform linear pressure. An alternating current voltage and a direct current voltage are superimposed on the developing roll 33 and the developer supplying roll 34, whereby the electrostatic latent image is developed (toner image forming process).

Next, the toner image formed on the surface of the electrostatic latent image holding member 12 is conveyed to a contact area between the electrostatic latent image holding member 12 and the transfer unit 20, along with the rotation of the electrostatic latent image holding member 12 in the direction of arrow A. At this time, a recording medium 50 is inserted to and passed through the contact area by a paper conveying roll (not shown) in the direction of arrow C, and the toner image formed on the surface of the electrostatic latent image holding member 12 is transferred onto the surface of the recording medium 50 at the contact area, by the voltage applied between the electrostatic latent image holding member 12 and the transfer unit 20 (transfer process).

After the toner image has been transferred to the transfer unit 20, the toner remaining on the surface of the electrostatic latent image holding member 12 is removed by a cleaning blade of the cleaning member 22 (cleaning process), and the electrical charge on the surface is eliminated therefrom by the charge eliminating unit 24.

The recording medium 50 having the toner image transferred on the surface thereof is conveyed to the pressure contact portion 32 of the fixing unit 26. While passing through the pressure contact portion 32, the recording medium is heated by the fixing unit 26 in which the surface of the pressure contact portion 32 is heated by an internally equipped heating source (not shown), so that the toner image is fixed on the surface of the recording medium 50 to form an image.

Figure 2:
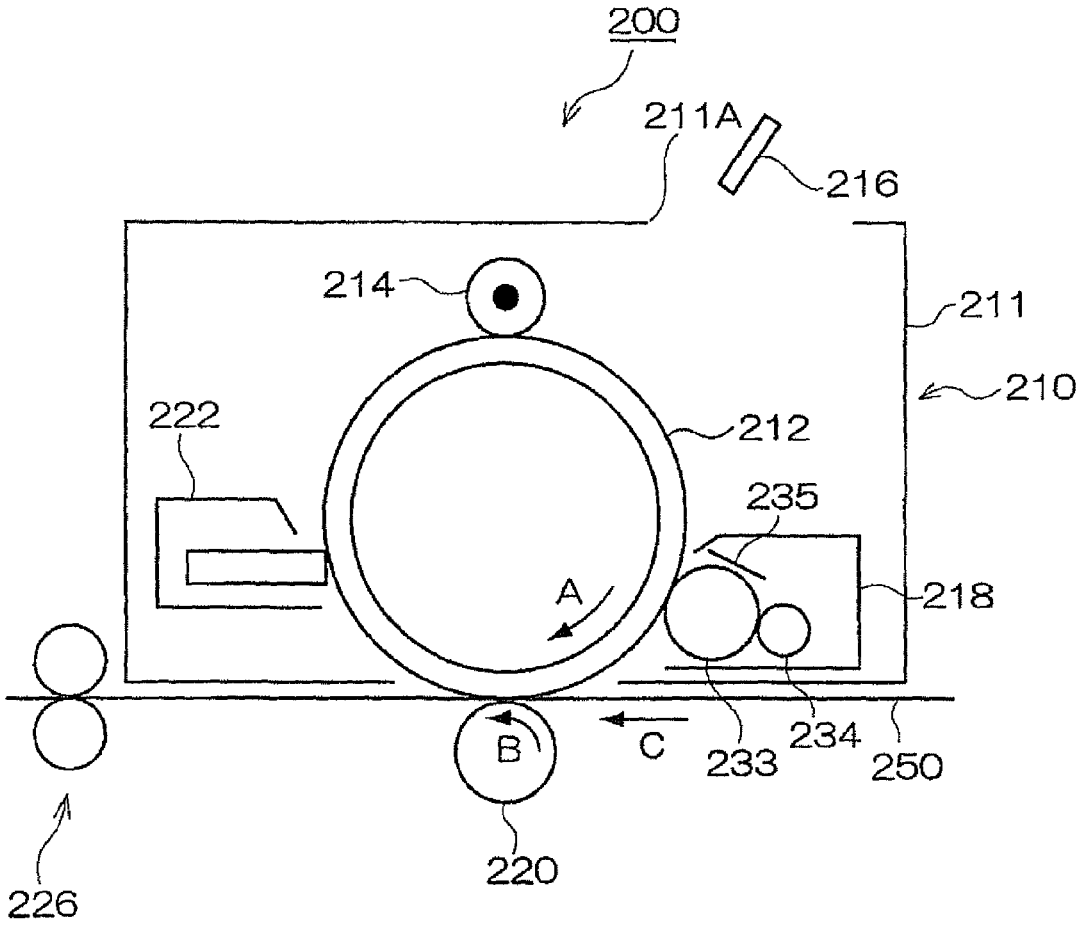
FIG. 2 is a configuration diagram schematically showing, the fundamental configuration of another exemplary embodiment of the image forming apparatus of the invention.

The image forming apparatus 200 shown in FIG. 2 includes a process cartridge 210 removably attached to the main body of the image forming apparatus (not shown), an electrostatic latent image forming unit 216, a transfer unit 220, and a fixing unit 226.

The process cartridge 210 includes an electrostatic latent image holding member 212, and a charging unit 214, a toner image forming unit 218, and a cleaning member 222 provided around the electrostatic latent image holding member, all of which are combined and integrated by means of a fitting rail (not shown) in a chassis 211 which has an opening 211A for electrostatic latent image formation. The process cartridge 210 is not limited to this configuration, and may include at least one selected from the group consisting of a toner image forming unit 218, an electrostatic latent image holding member 212, a charging unit 214, and a cleaning member 222.

Meanwhile, the electrostatic latent image forming unit 216 is disposed at a position where it may form an electrostatic latent image on the electrostatic latent image holding member 212 through the opening 211A of the chassis 211 of the process cartridge 210. The transfer unit 220 is disposed at a position facing the electrostatic latent image holding member 212.

Details of each of the electrostatic latent image holding member 212, the charging unit 214, the electrostatic latent image forming unit 216, the toner image forming unit 218, the transfer unit 220, the cleaning member 222, the fixing unit 226, the developing roll 233, the developer supplying roll 234, the layer forming blade 235, and the recording medium 250 are substantially the same as those of the electrostatic latent image holding member 12, the charging unit 14, the electrostatic latent image forming unit 16, the toner image forming unit 18, the transfer unit 20, the cleaning member 22, the fixing unit 26, the developing roll 33, the developer supplying roll 34, the layer forming blade 35, and the recording medium 50 of the image forming apparatus 10 shown in FIG. 1.

Furthermore, the processes of image formation using the image forming apparatus 200 shown in FIG. 2 are also substantially the same as the processes of image formation using the image forming apparatus 10 in FIG. 1.

EXAMPLES

Hereinafter, examples of the present invention will be described in detail, but embodiments are not limited to the Examples. In addition, in the following Examples, the term "parts" means "parts by weight," and the term "%" means "% by weight" unless otherwise stated.

Production of Toner

Production of Black Toner (1)

Preparation of Resin Microparticle Dispersion Liquid 370 parts of styrene, 30 parts of n-butyl acrylate, 8 parts of acrylic acid, 24 parts of dodecanethiol, and 4 parts of carbon tetrabromide are mixed to dissolution. This mixture is added to a flask containing a solution obtained by dissolving 6 parts of a nonionic surfactant (trade name: NONIPOLE 400, manufactured by Sanyo Chemical Industries, Ltd.) and 10 parts of an anionic surfactant (trade name: NEOGEN SC, manufactured by Dai-ichi Kogyo Seiyaku Co., Ltd.) in 550 parts of ion-exchanged water, so as to allow emulsion polymerization. While the mixture is mixed slowly for 10 minutes, 50 parts of ion-exchanged water having 4 parts of ammonium persulfate dissolved therein is introduced into the flask. After nitrogen purging is performed, the content in the flask is heated in an oil bath while being stirred, until the temperature of the content reaches 70° C., and emulsion polymerization is continued for 5 hours. As a result, a dispersion liquid having dispersed therein resin particles having a particle size of 150 nm, Tg of 58° C. and a weight average molecular weight (Mw) of 11,500 is obtained. The concentration of the solid content in the dispersion liquid is 40%.

Preparation of Black Colorant Dispersion Liquid

Carbon black (trade name: R330, manufactured by Cabot Corporation): 60 parts

Nonionic surfactant (trade name: NONIPOLE 400, manufactured by Sanyo Chemical Industries, Ltd.): 5 parts Ion-exchanged water: 240 parts The above components are mixed to dissolution, and the mixture is stirred for 10 minutes using a homogenizer (registered trade name: ULTRA-TURRAX T50, manufactured by IKA-Werke GmbH). Then, the mixture is subjected to a dispersion treatment for 10 minutes with an ultimizer, to thereby prepare a black colorant dispersion liquid having colorant (black pigment) particles having an average particle size of 250 nm dispersed therein.

Preparation of Release Agent Dispersion Liquid

Paraffin wax (trade name: HNP0190, manufactured by Nippon Seiro Co., Ltd., melting temperature: 85° C.): 100 parts Cationic surfactant (trade name: SANISOL B50, manufactured by Kao Corporation): 5 parts Ion-exchanged water: 240 parts The above components are subjected to dispersion in a round stainless steel flask for 10 minutes using a homogenizer (registered trade name: ULTRA-TURRAX T50, manufactured by IKA-Werke GmbH). Then, the mixture is subjected to a dispersion treatment with a pressure ejection type homogenizer, to thereby prepare a release agent dispersion liquid having release agent particles having an average particle size of 350 nm dispersed therein.

Resin microparticle dispersion liquid: 234 parts

Black colorant dispersion liquid: 30 parts

Release agent dispersion liquid: 40 parts

Polyaluminum chloride (trade name: PAC100W, manufactured by Asada Chemical Industry Co., Ltd.): 1.8 parts Ion-exchanged water: 600 parts The above components are mixed and subjected to dispersion in a round stainless steel flask using a homogenizer (registered trade name: ULTRA-TURRAX T50, manufactured by IKA-Werke GmbH), and then the content of the flask is heated to 52° C. in an oil bath for heating while being stirred. After the content is maintained at 52° C. for 120 minutes, it is confirmed that aggregate particles having a volume average particle size, D50, of 4.8 μm have been generated. After that, 32 parts of the resin microparticle dispersion liquid is further added to the dispersion liquid including the aggregate particles, the temperature of the oil bath for heating is raised to 53° C., and the mixture is maintained therein for 30 minutes. 1N sodium hydroxide is further added to the dispersion liquid including the aggregate particles to adjust pH of the system to 5.0, and then the stainless steel flask is sealed. While the content is continuously stirred using a magnetic seal, the content is heated to 95° C., and maintained at pH of 4.0 for 6 hours. After the system is cooled, mother toner particles are separated by filtration, washed 4 times with ion-exchanged water, and freeze-dried, to thereby obtain a black toner (1). The volume average particle size D50v, shape factor, particle size distribution on the fine particles side, and particle size distribution on the coarse particles side of the obtained toner are measured by the methods previously described (the measurement methods are also applied to the toners described hereinafter). As a result, the black toner (1) has a volume average particle size D50v of 5.5 μm, a shape factor of 120, a particle size distribution on the fine particles side of 1.25, and a particle size distribution on the coarse particles side of 1.30.

Production of Cyan Toner (1)

Preparation of Cyan Colorant Dispersion Liquid

Copper phthalocyanine blue pigment (C.I. Pigment Blue 15:3): 60 parts

Nonionic surfactant (trade name: NONIPOLE 400, manufactured by Sanyo Chemical Industry, Ltd.): 5 parts Ion-exchanged water: 240 parts The above components are mixed to dissolution, and the mixture is stirred for 10 minutes using a homogenizer (registered trade name: ULTRA-TURRAX T50, manufactured by IKA-Werke GmbH). Then, the mixture is subjected to a dispersion treatment for 10 minutes with an ultimizer, to thereby prepare a cyan colorant dispersion liquid having colorant (cyan pigment) particles having an average particle size of 280 nm dispersed therein.

A cyan toner (1) is obtained in the same manner as in the production of the black toner (1), except that 30 parts of the black colorant dispersion liquid used in the production of the black toner (1) is changed to 28 parts of the cyan colorant dispersion liquid. Then, the measurements are performed by the methods described above, and the cyan toner (1) is found to have a volume average particle size D50v of 5.5 μm, a shape factor of 120, a particle size distribution on the fine particles side of 1.25, and a particle size distribution on the coarse particles side of 1.30.

Production of Magenta Toner (1)

Preparation of Magenta Colorant Dispersion Liquid

C.I. Pigment Red 57:1: 60 parts

Nonionic surfactant (trade name: NONIPOLE 400, manufactured by Sanyo Chemical Industry, Ltd.): 5 parts Ion-exchanged water: 240 parts The above components are mixed to dissolution, and the mixture is stirred for 10 minutes using a homogenizer (registered trade name: ULTRA-TURRAX T50, manufactured by IKA-Werke GmbH). Then, the mixture is subjected to a dispersion treatment for 10 minutes with an ultimizer, to thereby prepare a magenta colorant dispersion liquid having colorant (magenta pigment) particles having an average particle size of 280 nm dispersed therein.

A magenta toner (1) is obtained in the same manner as in the production of the black toner (1), except that 30 parts of the black colorant dispersion liquid used in the production of the black toner (1) is changed to 32 parts of the magenta colorant dispersion liquid. The magenta toner (1) has a volume average particle size D50v of 5.5 μm, a shape factor of 120, a particle size distribution on the fine particles side of 1.25, and a particle size distribution on the coarse particles side of 1.30.

Production of Yellow Toner (1)

Preparation of Yellow Colorant Dispersion Liquid

C.I. Pigment Yellow 180: 60 parts

Nonionic surfactant (trade name: NONIPOLE 400, manufactured by Sanyo Chemical Industry, Ltd.): 5 parts Ion-exchanged water: 240 parts The above components are mixed to dissolution, and the mixture is stirred for 10 minutes using a homogenizer (registered trade name: ULTRA-TURRAX T50, manufactured by IKA-Werke GmbH). Then, the mixture is subjected to a dispersion treatment for 10 minutes with an ultimizer, to thereby prepare a yellow colorant dispersion liquid having colorant (yellow pigment) particles having an average particle size of 300 nm dispersed therein.

A yellow toner (1) is obtained in the same manner as in the production of the black toner (1), except that 30 parts of the black colorant dispersion liquid used in the production of the black toner (1) is changed to 35 parts of the yellow colorant dispersion liquid. The yellow toner (1) has a volume average particle size D50v of 5.5 μm, a shape factor of 120, a particle size distribution on the fine particles side of 1.25, and a particle size distribution on the coarse particles side of 1.30.

Production of Black Toner (2)

A black toner (2) is obtained in the same manner as in the production of the black toner (1), except that the retention time in the oil bath for heating at 52° C. in the production of the black toner (1) is changed to 240 minutes, the retention time at the oil bath for heating at a temperature of 53° C. is changed to 10 minutes, and the pH in the oil bath for heating at a temperature of 95° C. is changed to 5.0. The black toner (2) has a volume average particle size D50v of 7.5 μm, a shape factor of 135, a particle size distribution on the fine particles side of 1.35, and a particle size distribution on the coarse particles side of 1.45.

Production of Cyan Toner (2)

A cyan toner (2) is obtained in the same manner as in the production of the cyan toner (1), except that the retention time in the oil bath for heating at 52° C. in the production of the cyan toner (1) is changed to 240 minutes, the retention time in the oil bath for heating at a temperature of 53° C. is changed to 10 minutes, and the pH in the oil bath for heating at a temperature of 95° C. is changed to 5.0. The cyan toner (2) has a volume average particle size D50v of 7.5 μm, a shape factor of 135, a particle size distribution on the fine particles side of 1.35, and a particle size distribution on the coarse particles side of 1.45.

Production of Magenta Toner (2)

A magenta toner (2) is obtained in the same manner as in the production of the magenta toner (1), except that the retention time in the oil bath for heating at 52° C. in the production of the magenta toner (1) is changed to 240 minutes, the retention time at the oil bath for heating at a temperature of 53° C. is changed to 10 minutes, and the pH in the oil bath for heating at a temperature of 95° C. is changed to 5.0. The magenta toner (2) has a volume average particle size D50v of 7.5 μm, a shape factor of 135, a particle size distribution on the fine particles side of 1.35, and a particle size distribution on the coarse particles side of 1.45.

Production of Yellow Toner (2)

A yellow toner (2) is obtained in the same manner as in the production of the yellow toner (1), except that the retention time in the oil bath for heating at 52° C. in the production of the yellow toner (1) is changed to 240 minutes, the retention time at the oil bath for heating at a temperature of 53° C. is changed to 10 minutes, and the pH in the oil bath for heating at a temperature of 95° C. is changed to 5.0. The yellow toner (2) has a volume average particle size D50v of 7.5 μm, a shape factor of 135, a particle size distribution on the fine particles side of 1.35, and a particle size distribution on the coarse particles side of 1.45.

Production of Black Toner (3)

A black toner (3) is obtained in the same manner as in the production of the black toner (1), except that the pH in the oil bath for heating at a temperature of 95° C. in the production of the black toner (1) is changed to 4.5. The black toner (3) has a volume average particle size D50v of 5.5 μm, a shape factor of 130, a particle size distribution on the fine particles side of 1.25, and a particle size distribution on the coarse particles side of 1.30.

Production of Cyan Toner (3)

A cyan toner (3) is obtained in the same manner as in the production of the cyan toner (1), except that the pH in the oil bath for heating at a temperature of 95° C. in the production of the cyan toner (1) is changed to 4.5. The cyan toner (3) has a volume average particle size D50v of 5.5 μm, a shape factor of 130, a particle size distribution on the fine particles side of 1.25, and a particle size distribution on the coarse particles side of 1.30.

Production of Magenta Toner (3)

A magenta toner (3) is obtained in the same manner as in the production of the magenta toner (1), except that the pH in the oil bath for heating at a temperature of 95° C. in the production of the magenta toner (1) is changed to 4.5. The magenta toner (3) has a volume average particle size D50v of 5.5 μm, a shape factor of 130, a particle size distribution on the fine particles side of 1.25, and a particle size distribution on the coarse particles side of 1.30.

Production of Yellow Toner (3)

A yellow toner (3) is obtained in the same manner as in the production of the yellow toner (1), except that the pH in the oil bath for heating at a temperature of 95° C. in the production of the yellow toner (1) is changed to 4.5. The yellow toner (3) has a volume average particle size D50v of 5.5 μm, a shape factor of 130, a particle size distribution on the fine particles side of 1.25, and a particle size distribution on the coarse particles side of 1.30.

Production of Black Toner (4)

A black toner (4) is obtained in the same manner as in the production of the black toner (1), except that the pH in the oil bath for heating at a temperature of 95° C. in the production of the black toner (1) is chanced to 4.6. The black toner (4) has a volume average particle size D50v of 5.5 μm, a shape factor of 131, a particle size distribution on the fine particles side of 1.25, and a particle size distribution on the coarse particles side of 1.30.

Production of Cyan Toner (4)

A cyan toner (4) is obtained in the same manner as in the production of the cyan toner (1), except that the pH in the oil bath for heating at a temperature of 95° C. in the production of the cyan toner (1) is changed to 4.6. The cyan toner (4) has a volume average particle size D50v of 5.5 μm, a shape factor of 131, a particle size distribution on the fine particles side of 1.25, and a particle size distribution on the coarse particles side of 1.30.

Production of Magenta Toner (4)

A magenta toner (4) is obtained in the same manner as in the production of the magenta toner (1), except that the pH in the oil bath for heating at a temperature of 95° C. in the production of the magenta toner (1) is changed to 4.6. The magenta toner (4) has a volume average particle size D50v of 5.5 μm, a shape factor of 131, a particle size distribution on the fine particles side of 1.25, and a particle size distribution on the coarse particles side of 1.30.

Production of Yellow Toner (4)

A yellow toner (4) is obtained in the same manner as in the production of the yellow toner (1), except that the pH in the oil bath for heating at a temperature of 95° C. in the production of the yellow toner (1) is changed to 4.6. The yellow toner (4) has a volume average particle size D50v of 5.5 μm, a shape factor of 131, a particle size distribution on the fine particles side of 1.25, and a particle size distribution on the coarse particles side of 1.30.

Production of Black Toner (5)

A black toner (5) is obtained in the same manner as in the production of the black toner (1), except that the retention time in the oil bath for heating at 52° C. in the production of the black toner (1) is changed to 50 minutes. The black toner (5) has a volume average particle size D50v of 2.9 μm, a shape factor of 120, a particle size distribution on the fine particles side of 1.25, and a particle size distribution on the coarse particles side of 1.30.

Production of Cyan Toner (5)

A cyan toner (5) is obtained in the same manner as in the production of the cyan toner (1), except that the retention time in the oil bath for heating at 52° C. in the production of the cyan toner (1) is changed to 50 minutes. The cyan toner (5) has a volume average particle size D50v of 2.9 μm, a shape factor of 120, a particle size distribution on the fine particles side of 1.25, and a particle size distribution on the coarse particles side of 1.30.

Production of Magenta Toner (5)

A magenta toner (5) is obtained in the same manner as in the production of the magenta toner (1), except that the retention time in the oil bath for heating at 52° C. in the production of the magenta toner (1) is changed to 50 minutes. The magenta toner (5) has a volume average particle size D50v of 2.9 μm, a shape factor of 120, a particle size distribution on the fine particles side of 1.25, and a particle size distribution on the coarse particles side of 1.30.

Production of Yellow Toner (5)

A yellow toner (5) is obtained in the same manner as in the production of the yellow toner (1), except that the retention time in the oil bath for heating at 52° C. in the production of the yellow toner (1) is changed to 50 minutes. The yellow toner (5) has a volume average particle size D50v of 2.9 μm, a shape factor of 120, a particle size distribution on the fine particles side of 1.25, and a particle size distribution on the coarse particles side of 1.30.

Production of Black Toner (6)

A black toner (6) is obtained in the same manner as in the production of the black toner (1), except that the retention time in the oil bath for heating at 52° C. in the production of the black toner (1) is changed to 60 minutes. The black toner (6) has a volume average particle size D50v of 3.0 μm, a shape factor of 120, a particle size distribution on the fine particles side of 1.25, and a particle size distribution on the coarse particles side of 1.30.

Production of Cyan Toner (6)

A cyan toner (6) is obtained in the same manner as in the production of the cyan toner (1), except that the retention time in the oil bath for heating at 52° C. in the production of the cyan toner (1) is changed to 60 minutes. The cyan toner (6) has a volume average particle size D50v of 3.0 μm, a shape factor of 120, a particle size distribution on the fine particles side of 1.25, and a particle size distribution on the coarse particles side of 1.30.

Production of Magenta Toner (6)

A magenta toner (6) is obtained in the same manner as in the production of the magenta toner (1), except that the retention time in the oil bath for heating at 52° C. in the production of the magenta toner (1) is chanced to 60 minutes. The magenta toner (6) has a volume average particle size D50v of 3.0 μm, a shape factor of 120, a particle size distribution on the fine particles side of 1.25, and a particle size distribution on the coarse particles side of 1.30.

Production of Yellow Toner (6)

A yellow toner (6) is obtained in the same manner as in the production of the yellow toner (1), except that the retention time in the oil bath for heating at 52° C. in the production of the yellow toner (1) is changed to 60 minutes. The yellow toner (6) has a volume average particle size D50v of 3.0 μm, a shape factor of 120, a particle size distribution on the fine particles side of 1.25, and a particle size distribution on the coarse particles side of 1.30.

Production of Black Toner (7)

A black toner (7) is obtained in the same manner as in the production of the black toner (1), except that the retention time in the oil bath for heating at 52° C. in the production of the black toner (1) is changed to 180 minutes. The black toner (7) has a volume average particle size D50v of 6.5 μm, a shape factor of 120, a particle size distribution on the fine particles side of 1.25, and a particle size distribution on the coarse particles side of 1.30.

Production of Cyan Toner (7)

A cyan toner (7) is obtained in the same manner as in the production of the cyan toner (1), except that the retention time in the oil bath for heating at 52° C. in the production of the cyan toner (1) is changed to 180 minutes. The cyan toner (7) has a volume average particle size D50v of 6.5 μm, a shape factor of 120, a particle size distribution on the fine particles side of 1.25, and a particle size distribution on the coarse particles side of 1.30.

Production of Magenta Toner (7)

A magenta toner (7) is obtained in the same manner as in the production of the magenta toner (1), except that the retention time in the oil bath for heating at 52° C. in the production of the magenta toner (1) is changed to 180 minutes. The magenta toner (7) has a volume average particle size D50v of 6.5 μm, a shape factor of 120, a particle size distribution on the fine particles side of 1.25, and a particle size distribution on the coarse particles side of 1.30.

Production of Yellow Toner (7)

A yellow toner (7) is obtained in the same manner as in the production of the yellow toner (1), except that the retention time in the oil bath for heating at 52° C. in the production of the yellow toner (1) is changed to 180 minutes. The yellow toner (7) has a volume average particle size D50v of 6.5 μm, a shape factor of 120, a particle size distribution on the fine particles side of 1.25, and a particle size distribution on the coarse particles side of 1.30.

Production of Black Toner (8)

A black toner (8) is obtained in the same manner as in the production of the black toner (1), except that the retention time in the oil bath for heating at 52° C. in the production of the black toner (1) is changed to 200 minutes. The black toner (8) has a volume average particle size D50v of 6.6 μm, a shape factor of 120, a particle size distribution on the fine particles side of 1.25, and a particle size distribution on the coarse particles side of 1.30.

Production of Cyan Toner (8)

A cyan toner (8) is obtained in the same manner as in the production of the cyan toner (1), except that the retention time in the oil bath for heating at 52° C. in the production of the cyan toner (1) is changed to 200 minutes. The cyan toner (8) has a volume average particle size D50v of 6.6 μm, a shape factor of 120, a particle size distribution on the fine particles side of 1.25, and a particle size distribution on the coarse particles side of 1.30.

Production of Magenta Toner (8)

A magenta toner (8) is obtained in the same manner as in the production of the magenta toner (1), except that the retention time in the oil bath for heating at 52° C. in the production of the magenta toner (1) is changed to 200 minutes. The magenta toner (8) has a volume average particle size D50v of 6.6 μm, a shape factor of 120, a particle size distribution on the fine particles side of 1.25, and a particle size distribution on the coarse particles side of 1.30.

Production of Yellow Toner (8)

A yellow toner (8) is obtained in the same manner as in the production of the yellow toner (1), except that the retention time in the oil bath for heating at 52° C. in the production of the yellow toner (1) is changed to 200 minutes. The yellow toner (8) has a volume average particle size D50v of 6.6 μm, a shape factor of 120, a particle size distribution on the fine particles side of 1.25, and a particle size distribution on the coarse particles side of 1.30.

Production of Black Toner (9)

A black toner (9) is obtained in the same manner as in the production of the black toner (1), except that the retention time in the oil bath for heating at 53° C. in the production of the black toner (1) is changed to 20 minutes. The black toner (9) has a volume average particle size D50v of 5.5 μm, a shape factor of 120, a particle size distribution on the fine particles side of 1.30, and a particle size distribution on the coarse particles side of 1.35.

Production of Cyan Toner (9)

A cyan toner (9) is obtained in the same manner as in the production of the cyan toner (1), except that the retention time in the oil bath for heating at 53° C. in the production of the cyan toner (1) is changed to 20 minutes. The cyan toner (9) has a volume average particle size D50v of 5.5 μm, a shape factor of 120, a particle size distribution on the fine particles side of 1.30, and a particle size distribution on the coarse particles side of 1.35.

Production of Magenta Toner (9)

A magenta toner (9) is obtained in the same manner as in the production of the magenta toner (1), except that the retention time in the oil bath for heating at 53° C. in the production of the magenta toner (1) is changed to 20 minutes. The magenta toner (9) has a volume average particle size D50v of 5.5 μm, a shape factor of 120, a particle size distribution on the fine particles side of 1.30, and a particle size distribution on the coarse particles side of 1.35.

Production of Yellow Toner (9)

A yellow toner (9) is obtained in the same manner as in the production of the yellow toner (1), except that the retention time in the oil bath for heating at 53° C. in the production of the yellow toner (1) is changed to 20 minutes. The yellow toner (9) has a volume average particle size D50v of 5.5 μm, a shape factor of 120, a particle size distribution on the fine particles side of 1.30, and a particle size distribution on the coarse particles side of 1.35.

Production of Black Toner (10)

A black toner (10) is obtained in the same manner as in the production of the black toner (1), except that the retention time in the oil bath for heating at 53° C. in the production of the black toner (1) is changed to 18 minutes. The black toner (10) has a volume average particle size D50v of 5.5 μm, a shape factor of 120, a particle size distribution on the fine particles side of 1.31, and a particle size distribution on the coarse particles side of 1.36.

Production of Cyan Toner (10)

A cyan toner (10) is obtained in the same manner as in the production of the cyan toner (1), except that the retention time in the oil bath for heating at 53° C. in the production of the cyan toner (1) is changed to 18 minutes. The cyan toner (10) has a volume average particle size D50v of 5.5 μm, a shape factor of 120, a particle size distribution on the fine particles side of 1.31, and a particle size distribution on the coarse particles side of 1.36.

Production of Magenta Toner (10)

A magenta toner (10) is obtained in the same manner as in the production of the magenta toner (1), except that the retention time in the oil bath for heating at 53° C. in the production of the magenta toner (1) is changed to 18 minutes. The magenta toner (10) has a volume average particle size D50v of 5.5 μm, a shape factor of 120, a particle size distribution on the fine particles side of 1.31, and a particle size distribution on the coarse particles side of 1.36.

Production of Yellow Toner (10)

A yellow toner (10) is obtained in the same manner as in the production of the yellow toner (1), except that the retention time in the oil bath for heating at 53° C. in the production of the yellow toner (1) is changed to 18 minutes. The yellow toner (10) has a volume average particle size D50v of 5.5 μm, a shape factor of 120, a particle size distribution on the fine particles side of 1.31, and a particle size distribution on the coarse particles side of 1.36.

Production of Toner Having External Additive Thereon

Subsequently, external additives are added to 100 parts of each of the obtained toners by mixing the toner with the external additives in a sample mill. The external additives are 1.3 parts of silicone oil-treated silicon oxide microparticles having an average particle size of 40 nm (trade name: RY50, manufactured by Nippon Aerosil Co., Ltd.), and 1.5 parts of microparticles obtained by treating titanium oxide having an average particle size of 20 nm (trade name: MT150AW, manufactured by Tayca Corporation) with 20% decyltrimethoxysilane.

Production of Carrier A

Mn—Mg—Sr ferrite particles (average particle size: 40 μm, BET specific surface area: 0.1500 $m^2/g$, A/a; 4.5, shape factor; 125): 100 parts Toluene: 14 parts Cyclohexyl methacrylate/dimethylaminoethyl methacrylate copolymer (ratio of copolymerization by weight 99:5, Mw 80,000): 2.0 parts Carbon black (trade name: #25, manufactured by Mitsubishi Chemical Corporation): 0.12 parts The above components excluding the Mn—Mg—Sr ferrite particles, and glass beads (ϕ 1 mm, in the same amount as that of toluene) are stirred at 1,200 ppm/30 min using a sand mill (manufactured by Kansai Paint Co., Ltd.) to obtain a solution for forming a resin coating layer. Further, the solution for forming a resin coating layer, 0.5 parts of vinyltrimethoxysilane, and the Mn—Mg—Sr ferrite particles are put into a vacuum deaeration kneader, and the mixture is stirred at 5 rpm for 120 minutes at a constant temperature of 60° C. Then, the pressure is reduced to 0.080 MPa, and the mixture is dried at a temperature of 85° C. for 150 minutes to slowly remove toluene, to thereby produce a resin coated carrier A. The BET specific surface area of the carrier A as measured by the method previously described is 0.3800 $m^2/g$, the volume average particle size thereof is 42 μm, and the shape factor thereof is 125.

Production of Carrier B

A carrier B is obtained in the same manner as in the production of the carrier A, except that the degree of pressure reduction in the production of carrier A is changed to 0.090 MPa. The carrier B has a BET specific surface area of 0.2300 $m^2/g$, a volume average particle size of 42 μm, and a shape factor of 125.

Production of Carrier C

A carrier C is obtained in the same manner as in the production of the carrier A, except that the degree of pressure reduction in the production of carrier A is changed to 0.072 MPa. The carrier C has a BET specific surface area of 0.5400 $m^2/g$, a volume average particle size of 42 μm, and a shape factor of 125.

Production of Carrier D

A carrier D is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.1400 $m^2/g$, an A/a of 4.5, and a shape factor of 125. The carrier D has a BET specific surface area of 0.3700 $m^2/g$, a volume average particle size of 42 μm, and a shape factor of 125.

Production of Carrier E

A carrier E is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.2400 $m^2/g$, an A/a of 4.8, and a shape factor of 125. The carrier E has a BET specific surface area of 0.4700 $m^2/g$, a volume average particle size of 42 μm, and a shape factor of 125.

Production of Carrier F

A carrier F is obtained in the same manner as in the production of the carrier A, except that the degree of pressure reduction in the production of carrier A is changed to 0.086 MPa. The carrier F has a BET specific surface area of 0.2800 $m^2/g$, a volume average particle size of 42 μm, and a shape factor of 125.

Production of Carrier G

A carrier G is obtained in the same manner as in the production of the carrier A, except that the degree of pressure reduction in the production of carrier A is changed to 0.085 MPa. The carrier G has a BET specific surface area of 0.3000 $m^2/g$, a volume average particle size of 42 μm, and a shape factor of 125.

Production of Carrier H

A carrier H is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.1400 $m^2/g$, an A/a of 4.5, and a shape factor of 125, and the degree of pressure reduction is changed to 0.090 MPa. The carrier H has a BET specific surface area of 0.2200 $m^2/g$, a volume average particle size of 42 μm, and a shape factor of 125.

Production of Carrier I

A carrier I is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.2400 $m^2/g$, an A/a of 4.8, and a shape factor of 125, and the degree of pressure reduction is changed to 0.090 MPa. The carrier I has a BET specific surface area of 0.3200 $m^2/g$, a volume average particle size of 42 μm, and a shape factor of 125.

Production of Carrier J

A carrier J is obtained in the same manner as in the production of the carrier A, except that the degree of pressure reduction in the production of carrier A is changed to 0.092

MPa. The carrier J has a BET specific surface area of 0.1900 $m^2/g$, a volume average particle size of 42 μm, and a shape factor of 125.

Production of Carrier K

A carrier K is obtained in the same manner as in the production of the carrier A, except that the degree of pressure reduction in the production of carrier A is changed to 0.095 MPa. The carrier K has a BET specific surface area of 0.1300 $m^2/g$, a volume average particle size of 42 μm, and a shape factor of 125.

Production of Carrier L

A carrier L is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.1200 $m^2/g$, an A/a of 4.1, and a shape factor of 125, and also the degree of pressure reduction is chanced to 0.080 MPa. The carrier L has a BET specific surface area of 0.3500 $m^2/g$, a volume average particle size of 42 μm, and a shape factor of 125.

Production of Carrier M

A carrier M is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.2600 $m^2/g$, an A/a of 4.8, and a shape factor of 125, and also the degree of pressure reduction is changed to 0.080 MPa. The carrier M has a BET specific surface area of 0.4900 $m^2/g$, a volume average particle size of 42 μm, and a shape factor of 125.

Production of Carrier N

A carrier N is obtained in the same manner as in the production of the carrier A, except that the degree of pressure reduction in the production of carrier A is changed to 0.070 MPa. The carrier N has a BET specific surface area of 0.5600 $m^2/g$, a volume average particle size of 42 μm, and a shape factor of 125.

Production of Carrier O

A carrier O is obtained in the same manner as in the production of the carrier A, except that the degree of pressure reduction in the production of carrier A is changed to 0.093 MPa. The carrier O has a BET specific surface area of 0.1700 $m^2/g$, a volume average particle size of 42 μm, and a shape factor of 125.

Production of Carrier P

A carrier P is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.1200 $m^2/g$, an A/a of 4.1, and a shape factor of 125, and also the degree of pressure reduction is changed to 0.090 MPa. The carrier P has a BET specific surface area of 0.2000 $m^2/g$, a volume average particle size of 42 μm, and a shape factor of 125.

Production of Carrier Q

A carrier Q is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.2600 $m^2/g$, an A/a of 4.8, and a shape factor of 125, and also the degree of pressure reduction is changed to 0.090 MPa. The carrier Q has a BET specific surface area of 0.3400 $m^2/g$, a volume average particle size of 42 μm, and a shape factor of 125.

Production of Carrier R

A carrier R is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 18 μm, a BET specific surface area of 0.1500 $m^2/g$, an A/a of 4.5, and a shape factor of 125, and also the degree of pressure reduction is changed to 0.090 MPa. The carrier R has a BET specific surface area of 0.2300 $m^2/g$, a volume average particle size of 19 μm, and a shape factor of 125.

Production of Carrier S

A carrier S is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 19 μm, a BET specific surface area of 0.1500 $m^2/g$, an A/a of 4.5, and a shape factor of 125, and also the degree of pressure reduction is changed to 0.090 MPa. The carrier S has a BET specific surface area of 0.2300 $m^2/g$, a volume average particle size of 20 μm, and a shape factor of 125.

Production of Carrier T

A carrier T is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 57 μm, a BET specific surface area of 0.1500 $m^2/g$, an A/a of 4.5, and a shape factor of 125, and also the degree of pressure reduction is changed to 0.090 MPa. The carrier T has a BET specific surface area of 0.2300 $m^2/g$, a volume average particle size of 60 μm, and a shape factor of 125.

Production of Carrier U

A carrier U is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 58 μm, a BET specific surface area of 0.1500 $m^2/g$, an A/a of 4.5, and a shape factor of 125, and also the degree of pressure reduction is changed to 0.090 MPa. The carrier U has a BET specific surface area of 0.2300 $m^2/g$, a volume average particle size of 61 μm, and a shape factor of 125.

Production of Carrier V

A carrier V is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.1500 $m^2/g$, an A/a of 4.5, and a shape factor of 130, and also the degree of pressure reduction is changed to 0.090 MPa. The carrier V has a BET specific surface area of 0.2300 $m^2/g$, a volume average particle size of 42 μm, and a shape factor of 130.

Production of Carrier W

A carrier W is obtained in the same manner as in the production of the carrier A, except that 100 parts of the Mn—Mg—Sr ferrite particles in the production of the carrier A is changed to 100 parts of Mn—Mg—Sr ferrite particles having an average particle size of 40 μm, a BET specific surface area of 0.1500 $m^2/g$, an A/a of 4.5, and a shape factor of 131, and also the degree of pressure reduction is changed to 0.090 MPa. The carrier W has a BET specific surface area of 0.2300 $m^2/g$, a volume average particle size of 42 μm, and a shape factor of 131.

EXAMPLE 1

8 parts each of the black toner (1), yellow toner (1), cyan toner (1) and magenta toner (1), each having the external additives added thereto, and 100 parts of the carrier A are stirred in a V-blender at 40 rpm for 20 minutes, and the mixture is sieved with a sieve having a mesh size of 212 μm, to thereby obtain developers for 4 colors. Table 1 shows the general features of the toners and carriers used in Example 1, and Tables 1 and 2 show the general features of the toners and carriers used in the following Examples and Comparative Examples. In Tables 1 and 2, the term "difference in BET specific surface areas" means the difference in the BET specific surface areas obtained by subtracting the specific surface area of the magnetic particles from the BET specific surface area of the resin coated carrier.

The following copying test is performed by using the obtained developers, and a modified copying machine (trade name: DocuPrint 3200A, manufactured by Fuji Xerox Co., Ltd.) altered by removing the cleaning brush and setting the surface roughness Ra of the developer holding member to 0.5.

The copying test is performed under high temperature and high humidity conditions (30° C., 90% RH), and also under low temperature and low humidity conditions (10° C., 15% RH), respectively. In the test, a yellow image and a magenta image, each having a size of 7.5 cm×7.5 cm, are formed 5 cm away from the top edge of an A4-sized paper by using a yellow toner and a magenta toner, and a cyan image and a black image, each having a size of 7.5 cm×7.5 cm, are formed by using a cyan toner and a black toner below the yellow image and the magenta image; and then this pattern having the images of four colors are copied on 10,000 sheets. After copying on the first 10 sheets (denoted as initial point) and after copying on 10,000 sheets, evaluations are performed by the following evaluation methods, for color spots, stains inside the machine, and white spots under high temperature and high humidity conditions, and for image density, density unevenness and color spots under low temperature and low humidity conditions. The results are shown in Table 3.

Evaluation of color spots under high temperature and high humidity conditions

After copying on 10 sheets and 10,000 sheets, halftone images of the respective color are output, and the total number of color spots in the image is counted.

Evaluation of stains inside the machine under high temperature and high humidity conditions After copying on 10 sheets and 10,000 sheets, the top pats of the developing devices for colors are visually observed, and are evaluated according to the following criteria.

A: No stains are observed.

B: Stains are observed when the surface of the top parts of the developing device is viewed from an angle.

C: Stains are observed when the surface of the top parts of the developing device is viewed from a distance of 10 cm.

D: Stains are observed when the surface of the top parts of the developing device is viewed from a distance of 1 m.

Evaluation of white spots under high temperature and high humidity conditions

The total numbers of white spots in the images of the respective colors in the 10th sheet (initial point) and the 10,000th sheet are respectively counted.

Evaluation of Density Under Low Temperature and Low Humidity Conditions

The image density after copying on 10 sheets and the image density after copying on 10,000 sheets are measured for each color by using an X-RITE 938 (trade name, manufactured by X-rite Incorporated). The image density is measured at randomly selected 10 spots for each color, and the total average value is determined.

Evaluation of Density Unevenness Under Low Temperature and Low Humidity Conditions The image density after copying on 10 sheets and the image density after copying on 10,000 sheets are measured for each color by using an X-RITE 938 (trade name, manufactured by X-rite Incorporated). The image density is measured randomly at 10 spots for each color, the difference between the maximum value and the minimum value is determined for each color, and the total average value thereof is determined.

Evaluation of Color Spots Under Low Temperature and Low Humidity Conditions

After copying on 10 sheets (initial time) and after copying on 10,000 sheets, respectively, an A4-sized white paper is output, and the total number of color spots thereon is visually counted.

EXAMPLE 2

Developers are produced in the same manner as in Example 1, except that the black toner (1), yellow toner (1), cyan toner (1) and magenta toner (1) used in Example 1 are changed to the black toner (2), yellow toner (2), cyan toner (2) and magenta toner (2), respectively, and the carrier A is changed to the carrier B. The resultant developers are evaluated in the same manner as in Example 1. The results are shown in Table 3.

EXAMPLE 3

Developers are produced in the same manner as in Example 1, except that the black toner (1), yellow toner (1), cyan toner (1) and magenta toner (1) used in Example 1 are changed to the black toner (3), yellow toner (3), cyan toner (3) and magenta toner (3), respectively. The resultant developers are evaluated in the same manner as in Example 1. The results are shown in Table 3.

EXAMPLE 4

Developers are produced in the same manner as in Example 1, except that the black toner (1), yellow toner (1), cyan toner (1) and magenta toner (1) used in Example 1 are changed to the black toner (4), yellow toner (4), cyan toner (4) and magenta toner (4), respectively. The resultant developers are evaluated in the same manner as in Example 1. The results are shown in Table 3.

EXAMPLE 5

Developers are produced in the same manner as in Example 1, except that the black toner (1), yellow toner (1), cyan toner (1) and magenta toner (1) used in Example 1 are changed to the black toner (5), yellow toner (5), cyan toner (5) and magenta toner (5), respectively. The resultant developers are evaluated in the same manner as in Example 1. The results are shown in Table 3.

EXAMPLE 6

Developers are produced in the same manner as in Example 1, except that the black toner (1), yellow toner (1), cyan toner (1) and magenta toner (1) used in Example 1 are changed to the black toner (6), yellow toner (6), cyan toner (6) and magenta toner (6), respectively. The resultant developers are evaluated in the same manner as in Example 1. The results are shown in Table 3.

EXAMPLE 7

Developers are produced in the same manner as in Example 1, except that the black toner (1), yellow toner (1), cyan toner (1) and magenta toner (1) used in Example 1 are chanced to the black toner (7), yellow toner (7), cyan toner (7) and magenta toner (7), respectively. The resultant developers are evaluated in the same manner as in Example 1. The results are shown in Table 3.

EXAMPLE 8

Developers are produced in the same manner as in Example 1, except that the black toner (1), yellow toner (1), cyan toner (1) and magenta toner (1) used in Example 1 are changed to the black toner (8), yellow toner (8), cyan toner (8) and magenta toner (8), respectively. The resultant developers are evaluated in the same manner as in Example 1. The results are shown in Table 3.

EXAMPLE 9

Developers are produced in the same manner as in Example 1, except that the black toner (1), yellow toner (1), cyan toner (1) and magenta toner (1) used in Example 1 are changed to the black toner (9), yellow toner (9), cyan toner (9) and magenta toner (9), respectively. The resultant developers are evaluated in the same manner as in Example 1. The results are shown in Table 3.

EXAMPLE 10

Developers are produced in the same manner as in Example 1, except that the black toner (1), yellow toner (1), cyan toner (1) and magenta toner (1) used in Example 1 are changed to the black toner (10), yellow toner (10), cyan toner (10) and magenta toner (10), respectively. The resultant developers are evaluated in the same manner as in Example 1. The results are shown in Table 4.

EXAMPLE 11

Developers are produced in the same manner as in Example 1, except that the carrier A in Example 1 is changed to the carrier C. The resultant developers are evaluated in the same manner as in Example 1. The results are shown in Table 4.

EXAMPLE 12

Developers are produced in the same manner as in Example 1, except that the carrier A in Example 1 is changed to the carrier D. The resultant developers are evaluated in the same manner as in Example 1. The results are shown in Table 4.

EXAMPLE 13

Developers are produced in the same manner as in Example 1, except that the carrier A in Example 1 is changed to the carrier E. The resultant developers are evaluated in the same manner as in Example 1. The results are shown in Table 4.

EXAMPLE 14

Developers are produced in the same manner as in Example 1, except that the carrier A in Example 1 is changed to the carrier B. The resultant developers are evaluated in the same manner as in Example 1. The results are shown in Table 4.

EXAMPLE 15

Developers are produced in the same manner as in Example 1, except that the black toner (1), yellow toner (1), cyan toner (1) and magenta toner (1) in Example 1 are changed to the black toner (2), yellow toner (2), cyan toner (2) and magenta toner (2), respectively, and the carrier A is changed to the carrier F. The resultant developers are evaluated in the same manner as in Example 1. The results are shown in Table 4.

EXAMPLE 16

Developers are produced in the same manner as in Example 1, except that the black toner (1), yellow toner (1), cyan toner (1) and magenta toner (1) in Example 1 are chanced to the black toner (2), yellow toner (2), cyan toner (2) and magenta toner (2), respectively, and the carrier A is changed to the carrier G. The resultant developers are evaluated in the same manner as in Example 1. The results are shown in Table 4.

EXAMPLE 17

Developers are produced in the same manner as in Example 1, except that the black toner (1), yellow toner (1), cyan toner (1) and magenta toner (1) in Example 1 are changed to the black toner (2), yellow toner (2), cyan toner (2) and magenta toner (2), respectively, and the carrier A is changed to the carrier H. The resultant developers are evaluated in the same manner as in Example 1. The results are shown in Table 4.

EXAMPLE 18

Developers are produced in the same manner as in Example 1, except that the black toner (1), yellow toner (1), cyan toner (1) and magenta toner (1) in Example 1 are changed to the black toner (2), yellow toner (2), cyan toner (2) and magenta toner (2), respectively, and the carrier A is changed to the carrier I. The resultant developers are evaluated in the same manner as in Example 1. The results are shown in Table 4.

EXAMPLE 19

Developers are produced in the same manner as in Example 1, except that the carrier A in Example 1 is changed to the carrier J. The resultant developers are evaluated in the same manner as in Example 1. The results are shown in Table 4.

EXAMPLE 20

Developers are produced in the same manner as in Example 1, except that the black toner (1), yellow toner (1), cyan toner (1) and magenta toner (1) in Example 1 are changed to the black toner (2), yellow toner (2), cyan toner (2) and magenta toner (2), respectively, and the carrier A is changed to the carrier J. The resultant developers are evaluated in the same manner as in Example 1. The results are shown in Table 4.

EXAMPLE 21

Developers are produced in the same manner as in Example 1, except that the carrier A in Example 1 is changed to the carrier R. The resultant developers are evaluated in the same manner as in Example 1. The results are shown in Table 4.

EXAMPLE 22

Developers are produced in the same manner as in Example 1, except that the carrier A in Example 1 is changed to the carrier S. The resultant developers are evaluated in the same manner as in Example 1. The results are shown in Table 4.

EXAMPLE 23

Developers are produced in the same manner as in Example 1, except that the carrier A in Example 1 is changed to the carrier T. The resultant developers are evaluated in the same manner as in Example 1. The results are shown in Table 4.

EXAMPLE 24

Developers are produced in the same manner as in Example 1, except that the carrier A in Example 1 is changed to the carrier U. The resultant developers are evaluated in the same manner as in Example 1. The results are shown in Table 4.

EXAMPLE 25

Developers are produced in the same manner as in Example 1, except that the carrier A in Example 1 is changed to the carrier V. The resultant developers are evaluated in the same manner as in Example 1. The results are shown in Table 4.

EXAMPLE 26

Developers are produced in the same manner as in Example 1, except that the carrier A in Example 1 is changed to the carrier W. The resultant developers are evaluated in the same manner as in Example 1. The results are shown in Table 4.

COMPARATIVE EXAMPLE 1

Developers are produced in the same manner as in Example 1, except that the carrier A in Example 1 is changed to the carrier K. The resultant developers are evaluated in the same manner as in Example 1. The results are shown in Table 5.

COMPARATIVE EXAMPLE 2

Developers are produced in the same manner as in Example 2, except that the carrier B in Example 2 is changed to the carrier K. The resultant developers are evaluated in the same manner as in Example 1. The results are shown in Table 5.

COMPARATIVE EXAMPLE 3

Developers are produced in the same manner as in Example 1, except that the carrier A in Example 1 is changed to the carrier L. The resultant developers are evaluated in the same manner as in Example 1. The results are shown in Table 5.

COMPARATIVE EXAMPLE 4

Developers are produced in the same manner as in Example 1, except that the carrier A in Example 1 is changed to the carrier M. The resultant developers are evaluated in the same manner as in Example 1. The results are shown in Table 5.

COMPARATIVE EXAMPLE 5

Developers are produced in the same manner as in Example 1, except that the carrier A in Example 1 is changed to the carrier N. The resultant developers are evaluated in the same manner as in Example 1. The results are shown in Table 5.

COMPARATIVE EXAMPLE 6

Developers are produced in the same manner as in Example 1, except that the carrier A in Example 1 is changed to the carrier O. The resultant developers are evaluated in the same manner as in Example 1. The results are shown in Table 5.

COMPARATIVE EXAMPLE 7

Developers are produced in the same manner as in Example 1, except that the black toner (1), yellow toner (1), cyan toner (1) and magenta toner (1) in Example 1 are changed to the black toner (2), yellow toner (2), cyan toner (2) and magenta toner (2), respectively, and the carrier A is changed to the carrier P. The resultant developers are evaluated in the same manner as in Example 1. The results are shown in Table 5.

COMPARATIVE EXAMPLE 8

Developers are produced in the same manner as in Example 1, except that the black toner (1), yellow toner (1), cyan toner (1) and magenta toner (1) in Example 1 are changed to the black toner (2), yellow toner (2), cyan toner (2) and magenta toner (2), respectively, and the carrier A is changed to the carrier Q. The resultant developers are evaluated in the same manner as in Example 1. The results are shown in Table 5.

COMPARATIVE EXAMPLE 9

Developers are produced in the same manner as in Example 1, except that the black toner (1), yellow toner (1), cyan toner (1) and magenta toner (1) in Example 1 are changed to the black toner (2), yellow toner (2), cyan toner (2) and magenta toner (2), respectively, and the carrier A is changed to the carrier O. The resultant developers are evaluated in the same manner as in Example 1. The results are shown in Table 5.

TABLE 1

| | Carrier | | | Toner | | | | |
|---|---|---|---|---|---|---|---|---|
| | Type | BET specific surface area of magnetic particles ($m^2/g$) | Difference in BET specific surface areas ($m^2/g$) | No. | Shape factor | Volume average particle size (μm) | Particle size distribution on fine particles side | Particle size distribution on coarse particles side |
| Example 1 | A | 0.15 | 0.23 | 1 | 120 | 5.5 | 1.25 | 1.30 |
| Example 2 | B | 0.15 | 0.08 | 2 | 135 | 7.5 | 1.35 | 1.45 |
| Example 3 | A | 0.15 | 0.23 | 3 | 130 | 5.5 | 1.25 | 1.30 |
| Example 4 | A | 0.15 | 0.23 | 4 | 131 | 5.5 | 1.25 | 1.30 |
| Example 5 | A | 0.15 | 0.23 | 5 | 120 | 2.9 | 1.25 | 1.30 |
| Example 6 | A | 0.15 | 0.23 | 6 | 120 | 3.0 | 1.25 | 1.30 |
| Example 7 | A | 0.15 | 0.23 | 7 | 120 | 6.5 | 1.25 | 1.30 |
| Example 8 | A | 0.15 | 0.23 | 8 | 120 | 6.6 | 1.25 | 1.30 |
| Example 9 | A | 0.15 | 0.23 | 9 | 120 | 5.5 | 1.30 | 1.35 |
| Example 10 | A | 0.15 | 0.23 | 10 | 120 | 5.5 | 1.31 | 1.36 |
| Example 11 | C | 0.15 | 0.39 | 1 | 120 | 5.5 | 1.25 | 1.30 |
| Example 12 | D | 0.14 | 0.23 | 1 | 120 | 5.5 | 1.25 | 1.30 |
| Example 13 | E | 0.24 | 0.23 | 1 | 120 | 5.5 | 1.25 | 1.30 |
| Example 14 | B | 0.15 | 0.08 | 1 | 120 | 5.5 | 1.25 | 1.30 |
| Example 15 | F | 0.15 | 0.13 | 2 | 135 | 7.5 | 1.35 | 1.45 |
| Example 16 | G | 0.15 | 0.15 | 2 | 135 | 7.5 | 1.35 | 1.45 |
| Example 17 | H | 0.14 | 0.08 | 2 | 135 | 7.5 | 1.35 | 1.45 |
| Example 18 | I | 0.24 | 0.08 | 2 | 135 | 7.5 | 1.35 | 1.45 |
| Example 19 | J | 0.15 | 0.04 | 1 | 120 | 5.5 | 1.25 | 1.30 |

TABLE 2

| | Carrier | | | Toner | | | | |
|---|---|---|---|---|---|---|---|---|
| | Type | BET specific surface area of magnetic particles ($m^2/g$) | Difference in BET specific surface areas ($m^2/g$) | No. | Shape factor | Volume average particle size (μm) | Particle size distribution on fine particles side | Particle size distribution on coarse particles side |
| Example 20 | J | 0.15 | 0.04 | 2 | 135 | 7.5 | 1.35 | 1.45 |
| Example 21 | R | 0.15 | 0.08 | 1 | 120 | 5.5 | 1.25 | 1.30 |
| Example 22 | S | 0.15 | 0.08 | 1 | 120 | 5.5 | 1.25 | 1.30 |
| Example 23 | T | 0.15 | 0.08 | 1 | 120 | 5.5 | 1.25 | 1.30 |
| Example 24 | U | 0.15 | 0.08 | 1 | 120 | 5.5 | 1.25 | 1.30 |
| Example 25 | V | 0.15 | 0.08 | 1 | 120 | 5.5 | 1.25 | 1.30 |
| Example 26 | W | 0.15 | 0.08 | 1 | 120 | 5.5 | 1.25 | 1.30 |
| Comparative Example 1 | K | 0.15 | −0.02 | 1 | 120 | 5.5 | 1.25 | 1.30 |
| Comparative Example 2 | K | 0.15 | −0.02 | 2 | 135 | 7.5 | 1.35 | 1.45 |
| Comparative Example 3 | L | 0.12 | 0.23 | 1 | 120 | 5.5 | 1.25 | 1.30 |
| Comparative Example 4 | M | 0.26 | 0.23 | 1 | 120 | 5.5 | 1.25 | 1.30 |
| Comparative Example 5 | N | 0.15 | 0.41 | 1 | 120 | 5.5 | 1.25 | 1.30 |
| Comparative Example 6 | O | 0.15 | 0.02 | 1 | 120 | 5.5 | 1.25 | 1.30 |
| Comparative Example 7 | P | 0.12 | 0.08 | 2 | 135 | 7.5 | 1.35 | 1.45 |

TABLE 2-continued

| | Carrier | | | Toner | | | | |
|---|---|---|---|---|---|---|---|---|
| | | BET | | | | | | |
| | Type | specific surface area of magnetic particles ($m^2/g$) | Difference in BET specific surface areas ($m^2/g$) | No. | Shape factor | Volume average particle size (μm) | Particle size distribution on fine particles side | Particle size distribution on coarse particles side |
| Comparative Example 8 | Q | 0.26 | 0.08 | 2 | 135 | 7.5 | 1.35 | 1.45 |
| Comparative Example 9 | O | 0.15 | 0.02 | 2 | 135 | 7.5 | 1.35 | 1.45 |

TABLE 3

| | Under high temperature and high humidity conditions | | | | | | Under low temperature and low humidity conditions | | | | | |
|---|---|---|---|---|---|---|---|---|---|---|---|---|
| | After copying on 10 sheets | | | After copying on 10,000 sheets | | | After copying on 10 sheets | | | After copying on 10,000 sheets | | |
| | Color spots | Stain inside machine | White spots | Color spots | Stain inside machine | White spots | Density | Density unevenness | Color spots | Density | Density unevenness | Color spots |
| Example 1 | 0 | A | 0 | 3 | B | 3 | 1.45 | 0.01 | 0 | 1.44 | 0.01 | 1 |
| Example 2 | 0 | A | 0 | 0 | A | 1 | 1.45 | 0.03 | 0 | 1.40 | 0.09 | 9 |
| Example 3 | 0 | A | 0 | 3 | B | 3 | 1.45 | 0.02 | 0 | 1.43 | 0.05 | 5 |
| Example 4 | 0 | A | 0 | 3 | B | 3 | 1.45 | 0.03 | 0 | 1.42 | 0.06 | 6 |
| Example 5 | 0 | A | 0 | 3 | B | 3 | 1.45 | 0.03 | 0 | 1.42 | 0.06 | 6 |
| Example 6 | 0 | A | 0 | 3 | B | 3 | 1.45 | 0.02 | 0 | 1.43 | 0.05 | 5 |
| Example 7 | 0 | A | 0 | 3 | B | 3 | 1.45 | 0.02 | 0 | 1.43 | 0.05 | 5 |
| Example 8 | 0 | A | 0 | 3 | B | 3 | 1.45 | 0.02 | 0 | 1.42 | 0.06 | 6 |
| Example 9 | 0 | A | 0 | 3 | B | 3 | 1.45 | 0.02 | 0 | 1.43 | 0.05 | 5 |

TABLE 4

| | Under high temperature and high humidity conditions | | | | | | Under low temperature and low humidity conditions | | | | | |
|---|---|---|---|---|---|---|---|---|---|---|---|---|
| | After copying on 10 sheets | | | After copying on 10,000 sheets | | | After copying on 10 sheets | | | After copying on 10,000 sheets | | |
| | Color spots | Stain inside machine | White spots | Color spots | Stain inside machine | White spots | Density | Density unevenness | Color spots | Density | Density unevenness | Color spots |
| Example 10 | 0 | A | 0 | 3 | B | 3 | 1.45 | 0.03 | 0 | 1.42 | 0.06 | 6 |
| Example 11 | 0 | A | 0 | 4 | B | 5 | 1.45 | 0.01 | 0 | 1.44 | 0.03 | 3 |
| Example 12 | 0 | A | 0 | 3 | B | 4 | 1.45 | 0.01 | 0 | 1.44 | 0.02 | 2 |
| Example 13 | 0 | A | 0 | 4 | B | 4 | 1.45 | 0.01 | 0 | 1.44 | 0.02 | 3 |
| Example 14 | 0 | A | 0 | 0 | A | 0 | 1.45 | 0 | 0 | 1.45 | 0 | 0 |
| Example 15 | 0 | A | 0 | 1 | A | 1 | 1.45 | 0.03 | 0 | 1.41 | 0.07 | 7 |
| Example 16 | 0 | A | 0 | 2 | A | 2 | 1.45 | 0.03 | 0 | 1.41 | 0.07 | 8 |
| Example 17 | 0 | A | 0 | 2 | B | 2 | 1.45 | 0.03 | 0 | 1.41 | 0.07 | 9 |
| Example 18 | 0 | A | 0 | 2 | B | 2 | 1.45 | 0.03 | 0 | 1.41 | 0.07 | 7 |
| Example 19 | 0 | A | 0 | 1 | B | 1 | 1.45 | 0.01 | 0 | 1.44 | 0.03 | 2 |
| Example 20 | 0 | A | 0 | 1 | B | 2 | 1.45 | 0.04 | 0 | 1.40 | 0.09 | 6 |
| Example 21 | 0 | A | 0 | 5 | B | 5 | 1.45 | 0.03 | 0 | 1.42 | 0.06 | 6 |
| Example 22 | 0 | A | 0 | 3 | B | 3 | 1.45 | 0.02 | 0 | 1.43 | 0.05 | 5 |
| Example 23 | 0 | A | 0 | 2 | B | 3 | 1.45 | 0.02 | 0 | 1.43 | 0.05 | 5 |
| Example 24 | 0 | A | 0 | 5 | B | 5 | 1.45 | 0.03 | 0 | 1.42 | 0.06 | 6 |
| Example 25 | 0 | A | 0 | 3 | B | 3 | 1.45 | 0.02 | 0 | 1.43 | 0.05 | 5 |
| Example 26 | 0 | A | 0 | 5 | B | 5 | 1.45 | 0.03 | 0 | 1.42 | 0.06 | 6 |

TABLE 5

| | Under high temperature and high humidity conditions | | | | | | Under low temperature and low humidity conditions | | | | | |
|---|---|---|---|---|---|---|---|---|---|---|---|---|
| | After copying on 10 sheets | | | After copying on 10,000 sheets | | | After copying on 10 sheets | | | After copying on 10,000 sheets | | |
| | Color spots | Stain inside machine | White spots | Color spots | Stain inside machine | White spots | Density | Density unevenness | Color spots | Density | Density unevenness | Color spots |
| Comparative Example 1 | 2 | B | 2 | 8 | C | 8 | 1.43 | 0.05 | 3 | 1.37 | 0.11 | 10 |
| Comparative Example 2 | 1 | B | 2 | 8 | C | 8 | 1.43 | 0.06 | 4 | 1.35 | 0.15 | 12 |
| Comparative Example 3 | 2 | C | 1 | 8 | D | 9 | 1.41 | 0.05 | 3 | 1.33 | 0.13 | 11 |
| Comparative Example 4 | 2 | C | 2 | 8 | D | 8 | 1.41 | 0.05 | 3 | 1.33 | 0.13 | 11 |
| Comparative Example 5 | 3 | B | 4 | 10 | B | 12 | 1.42 | 0.05 | 5 | 1.36 | 0.11 | 11 |
| Comparative Example 6 | 1 | B | 1 | 6 | B | 6 | 1.42 | 0.05 | 4 | 1.36 | 0.10 | 10 |
| Comparative Example 7 | 1 | B | 2 | 6 | C | 7 | 1.43 | 0.07 | 3 | 1.35 | 0.14 | 15 |
| Comparative Example 8 | 2 | B | 1 | 6 | C | 7 | 1.43 | 0.07 | 3 | 1.35 | 0.14 | 14 |
| Comparative Example 9 | 2 | B | 2 | 6 | B | 6 | 1.43 | 0.06 | 3 | 1.35 | 0.13 | 13 |

It may be seen from the Tables 3 to 5 that all of the evaluation results for Example 1 through Example 26 are favorable.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A carrier for developing an electrostatic latent image, comprising carrier particles including magnetic particles and a coating layer coating the surfaces of the magnetic particles, the BET specific surface area of the magnetic particles being 0.1400 $m^2/g$ to 0.2200 $m^2/g$; and the difference in BET specific surface areas obtained by subtracting the BET specific surface area of the magnetic particles from the BET specific surface area of the carrier particles is 0.0500 $m^2/g$ to 0.1300 $m^2/g$, wherein the magnetic particles satisfy Expression (1), and the coating layer includes a copolymer of a monomer having an alicyclic group and a nitrogen-containing acrylic monomer:

$$3.5 \leq A/a \leq 7.0 \qquad \text{Expression (1)}$$

wherein A represents the BET specific surface area (unit: $m^2/g$) of the magnetic particles, and a represents the sphere-equivalent specific surface area (unit: $m^2/g$) of the magnetic particles.

2. The carrier for developing an electrostatic latent image of claim 1, wherein the volume average particle size of the carrier particles is about 20 μm to about 60 μm.

3. The carrier for developing an electrostatic latent image of claim 1, wherein the magnetic particles have a shape factor of about 100 to about 130, and the carrier particles have a shape factor of about 100 to about 130.

4. The carrier for developing an electrostatic latent image of claim 1, wherein the monomer having an alicyclic group is cyclohexyl methacrylate.

5. The carrier for developing an electrostatic latent image of claim 1, wherein the copolymerization ratio of the monomer having an alicyclic group to the nitrogen-containing acrylic monomer (monomer having an alicyclic monomer: nitrogen-containing acrylic monomer) is about 99.5:0.5 to about 60:40.

6. The carrier for developing an electrostatic latent image of claim 1, wherein the coating layer comprises an electroconductive powder.

7. The carrier for developing an electrostatic latent image of claim 6, wherein the electroconductive powder is carbon black.

8. The carrier for developing an electrostatic latent image of claim 6, wherein the electroconductive powder has a volume average particle size of about 0.5 μm or less.

9. The carrier for developing an electrostatic latent image of claim 6, wherein the electroconductive powder has a volume resistivity of about $10^1$ Ω·cm to about $10^{11}$ Ω·cm.

10. A developer for electrostatic latent image development, comprising:

toner particles; and the carrier for developing an electrostatic latent image of claim 1.

11. The developer for electrostatic latent image development of claim 10, wherein:

the toner particles include a colorant;

the toner particles have a shape factor of about 100 to about 130;

the volume average particle size of the toner particles is about 3.0 μm to about 6.5 μm; and the particle size distribution on the fine particles side of the toner particles is about 1.30 or less.

12. The developer for electrostatic latent image development of claim 10, wherein the ratio of toner particles having a shape factor of about 130 or larger with respect to the total number of the toner particles is about 10% by number or less.

13. The developer for electrostatic latent image development of claim 10, wherein the toner includes a polyolefin wax having a melting temperature of about 75° C. to about 105° C.

14. A method of forming an image, comprising at least:

charging the surface of an electrostatic latent image holding member;

forming an electrostatic latent image on the surface of the charged electrostatic latent image holding member;

forming a toner image by developing the electrostatic latent image formed on the surface of the electrostatic latent image holding member;

transferring the toner image onto a recording medium; and fixing the toner image transferred onto the recording medium, the developer being the developer for electrostatic latent image development of claim 10.

15. The method of forming an image of claim 14, wherein:

the forming of a toner image includes forming a toner image by developing the electrostatic latent image formed on the surface of the electrostatic latent image holding member, by using the developer held in a developer holding member; and the developer holding member has a surface roughness Ra of about 0.01 to about 1.0.

* * * * *